US008408862B1

(12) United States Patent
Westendorf

(10) Patent No.: US 8,408,862 B1
(45) Date of Patent: Apr. 2, 2013

(54) GUARD STRUCTURES FOR HYDRAULIC CYLINDERS, HYDRAULIC LINES, AND LOADER ARMS

(75) Inventor: Neal W. Westendorf, Dakota Dunes, SD (US)

(73) Assignee: Westendorf Manufacturing Co., Inc., Onawa, IA (US)

( * ) Notice: Subject to any disclaimer, the term of this patent is extended or adjusted under 35 U.S.C. 154(b) by 872 days.

(21) Appl. No.: 12/557,807

(22) Filed: Sep. 11, 2009

Related U.S. Application Data

(60) Provisional application No. 61/095,985, filed on Sep. 11, 2008.

(51) Int. Cl.
*B66C 23/00* (2006.01)

(52) U.S. Cl. ..... 414/722

(58) Field of Classification Search ..... 52/115, 52/116; 414/680, 722, 918
See application file for complete search history.

(56) References Cited

U.S. PATENT DOCUMENTS

| | | | |
|---|---|---|---|
| 3,252,606 | A | 5/1966 | Pryor |
| 3,292,804 | A | 12/1966 | Veneman |
| 3,812,282 | A | 5/1974 | Johansson |
| 3,850,141 | A | 11/1974 | Schmitt |
| 3,997,986 | A | 12/1976 | Black |
| 4,050,596 | A | 9/1977 | Zeuner |
| T974001 | I4 | 9/1978 | Neal |
| 4,156,487 | A | 5/1979 | Dowd |
| 4,167,991 | A | 9/1979 | Karklins |
| 4,193,734 | A | 3/1980 | Williams |
| 4,265,063 | A | 5/1981 | Muller |
| 4,267,674 | A | 5/1981 | Muller |
| 4,320,783 | A | 3/1982 | Neal |
| 4,372,429 | A | 2/1983 | Marx |
| 4,591,137 | A | 5/1986 | Steinberg |
| 4,644,094 | A | 2/1987 | Hoffman |
| 4,658,854 | A | 4/1987 | Hopkins |
| 5,074,390 | A | 12/1991 | Fuhrmann |
| 5,108,253 | A | 4/1992 | Kobayashi |
| 5,232,330 | A | 8/1993 | Rae |
| 5,542,339 | A | 8/1996 | Kaczmarczyk |
| 5,791,445 | A | 8/1998 | Kaufmann |
| 5,806,313 | A | 9/1998 | Koshi |
| 5,807,061 | A | 9/1998 | Donoghue |
| 6,171,050 | B1 | 1/2001 | Johnson |
| 6,425,730 | B1 | 7/2002 | Kaczmarski |
| 6,530,742 | B2 | 3/2003 | Trinler |
| 6,994,512 | B2 | 2/2006 | Stender |
| 7,008,169 | B1 | 3/2006 | Miyanishi |
| 7,021,668 | B2 | 4/2006 | Langenfeld |
| 7,070,383 | B2 | 7/2006 | Sugimoto |
| 7,219,780 | B2 | 5/2007 | Thurmann |

*Primary Examiner* — Michael Leslie
(74) *Attorney, Agent, or Firm* — Dowell IP, P.C.

(57) ABSTRACT

The hydraulic cylinder and line guard of the claimed invention substantially surrounds and protects both a hydraulic cylinder and portions of a hydraulic line. The guard also significantly reduces the visual appearance of the hydraulic lines. While maintaining the flexibility of the hydraulic lines at pivot points, the guard inhibits movement of the line near the cylinder thereby reducing wear on the line. The claimed invention also achieves the important objective of providing an aesthetically pleasing and easily replaceable guard for hydraulic cylinders and lines. The improved guard is achieved by utilizing a resilient guard to cover both the cylinder and the line. The guard may be formed from a single stretchable resilient tube that is deformed to enclose both the line and the cylinder, wherein a cross-section of the guard is defined primarily by combined cross sections of the cylinder adjacent to the line. The guard may also be formed from multiple interconnected resilient segments that combine to substantially enclose a hydraulic line and cylinder. The guard may further have a raised wear surface arranged in an ornamental and/or functional pattern.

18 Claims, 33 Drawing Sheets

PRIOR ART

FIG. 19
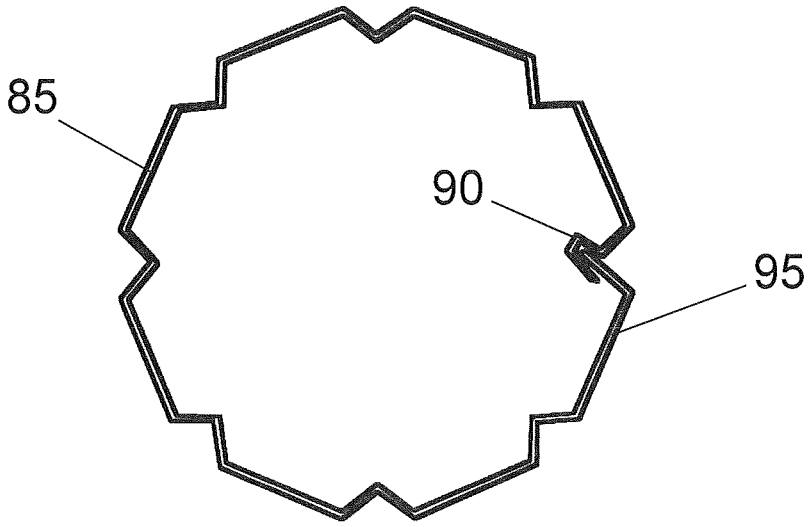
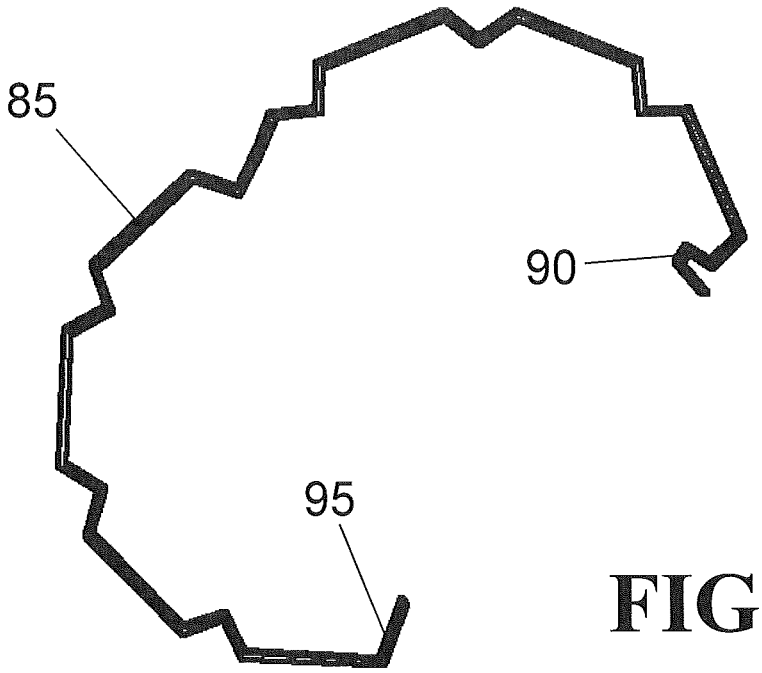
FIG. 20

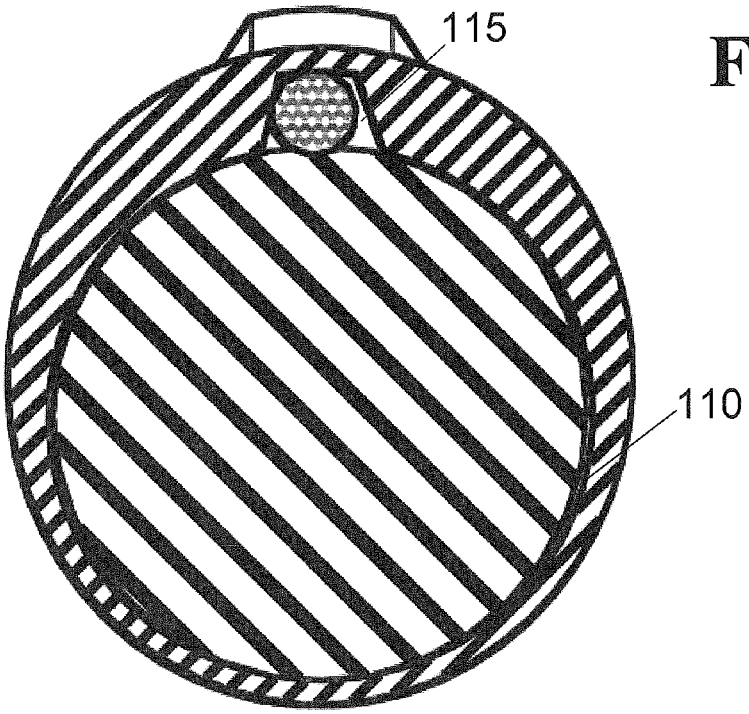
FIG. 23
FIG. 24
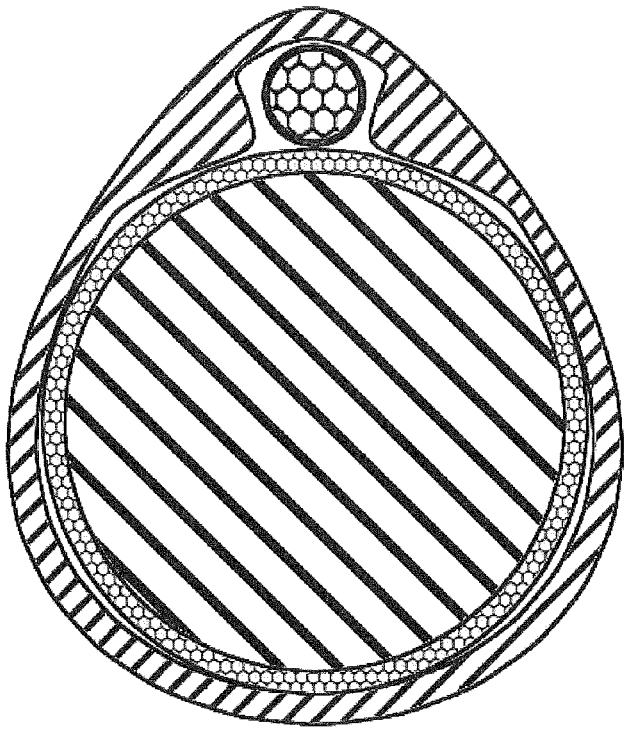

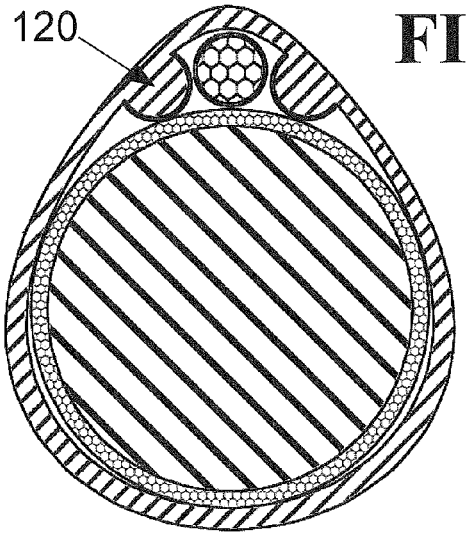
FIG. 25
FIG. 26
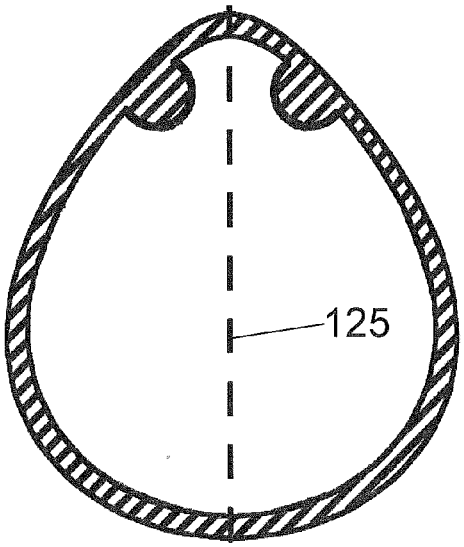
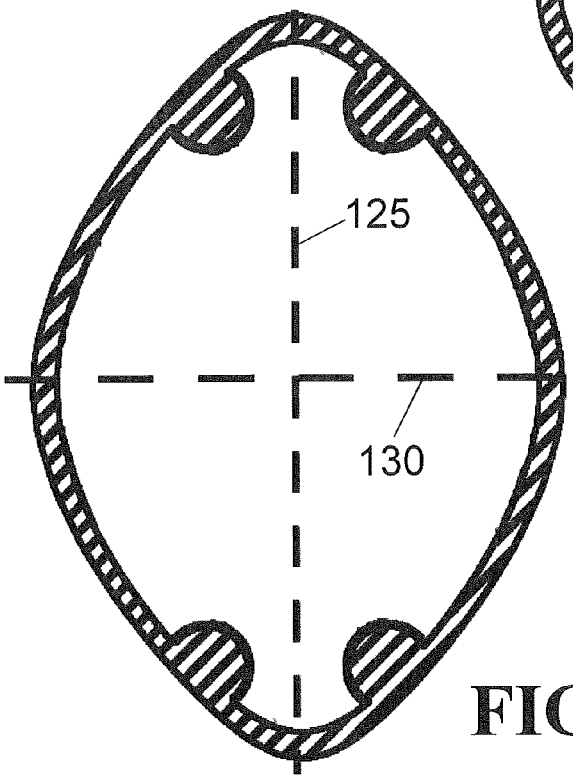
FIG. 27

FIG. 28
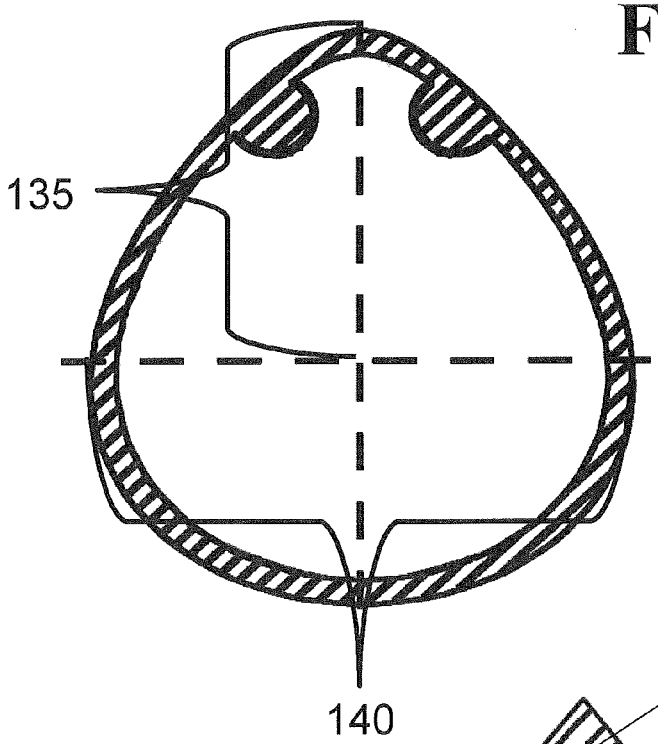
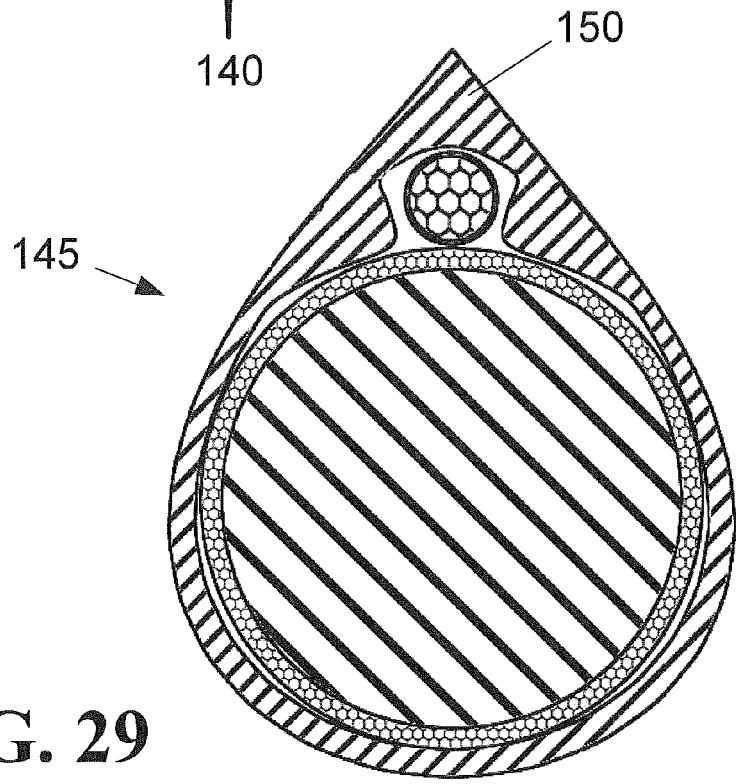
FIG. 29

GUARD STRUCTURES FOR HYDRAULIC CYLINDERS, HYDRAULIC LINES, AND LOADER ARMS

CROSS REFERENCE TO PENDING APPLICATION

This application claims the benefit of U.S. provisional application Ser. No. 61/095,985 entitled "Guard Structure for Hydraulic Cylinders, Hydraulic Lines, and Loader Arms" filed September 11, 2008 by Neal W. Westendorf and U.S. patent application Ser. Nos. 12/038,379 and 12/009,003 entitled "Guard Structure for Fluid Conduits of Hydraulic Cylinder and Hydraulic Lines" by Neal W. Westendorf, the entire contents of which are herein all incorporated by reference.

FIELD OF THE INVENTION

This invention relates to structures for protecting hydraulic conduits and for substantially removing the appearance of the conduits. This invention further relates to protecting hydraulic lines and cylinders on the booms of front-end loaders that have arm assemblies pivotally attached to buckets, clam shells, plows, fork lifts, bale spears and related implements.

BACKGROUND OF THE INVENTION

Agricultural and construction vehicles typically employ hydraulic cylinders to power a variety of specialty implements that attach to the vehicles. For example, typical front-end loaders have a pair of arms that are raised and lowered by hydraulic cylinders, as well as implements attached to the arms that are operated by hydraulic cylinders. Some exemplary front end loaders using hydraulic lines to power hydraulic cylinders are described by U.S. Pat. No. 3,512,665 to Westendorf; U.S. Pat. No. 4,085,856 to Westendorf; U.S. Pat. No. 4,787,811 to Langenfeld et al.; U.S. Pat. No. 4,051,962 to Westendorf; U.S. Pat. No. 4,606,692 to Langenfeld et al.; and U.S. Pat. No. 4,930,974 to Langenfeld et al., all incorporated herein by reference.

Hydraulic lines are required to deliver hydraulic fluid to hydraulic cylinders. Additionally, two way cylinders must be connected to hydraulic lines at two ports typically located on opposite ends of the cylinders. In order to provide hydraulic fluid to most commonly available cylinders, at least one hydraulic line is usually strung along the cylinder to connect near the rod end of the cylinder. Thus, loaders that have multiple two way cylinders to operate implements are typically required to have many (often unsightly) hydraulic lines strung along the arms of the loader as shown in FIGS. 1-4. Loaders with complex implements, such as pinching fingers, often have even more hydraulic lines.

It is known in the prior art, as shown in FIG. 1 from U.S. Pat. No. 4,050,596 and FIGS. 2-4, that hydraulic cylinders 10 and hydraulic lines 15 connected to lift arms 20 and implement attachments 25 are commonly located on portions of loaders 30 exposed to potentially rough environments. Hydraulic lines 15 are particularly susceptible to being snagged on objects since the lines must be relatively slack to allow for movement of the hydraulic cylinders. Hydraulic lines 15 connected to the lift arm 20 may also snag on or be pinched by the engine compartment 35 when the lift arms are raised and lowered.

The problem of developing a guard structure for hydraulic lines is further complicated by the flexible hydraulic conduits extending along the boom. The guard structure must not interfere with the movement of the hydraulic lines at key loader arm pivot points. The required movement of the cylinders relative to one another hinders development of a single satisfactory guard structure capable of protecting numerous hydraulic lines and cylinders of a front end loader.

In addition to being subject to snagging during operation, exposed hydraulic lines also often create an unrefined appearance for the vehicle, as shown in FIGS. 1-4 of the present application. Improvements to the appearance of hydraulic cylinders and lines have been proposed, such as those shown in U.S. Pat. No. D184,544 issued to Pessler, U.S. Pat. No. D194,362 issued to Prince, and U.S. Pat. No. D408,420 issued to Büter. Previous attempts to reduce the appearance of hydraulic lines have involved complicated and expensive methods such as the hydraulic cylinder with dual internal fluid conduits disclosed in U.S. Pat. Nos. 7,243,593 and 6,994,512 issued to Westendorf. Further improvements, however, in the appearance, cost, and function of devices that protect both hydraulic lines and hydraulic cylinders are desired.

There have been attempts to develop guards for hydraulic lines and cylinders such as those disclosed by U.S. Pat. Nos. 4,265,063 and 4,267,674 issued to Muller. However, these guards disclosed by Muller do not completely surround the hydraulic cylinders and lines. Additionally, the Muller guards do not significantly immobilize portions of the hydraulic lines adjacent to the hydraulic cylinders. The Muller guards are also fabricated from heavy sheet metal, making them expensive to fabricate, install and replace, and therefore not readily adaptable for certain applications, especially on lighter duty vehicles.

Accordingly, an object of the present invention is to provide a guard structure that protects hydraulic cylinders and lines from damage.

Another object of the present invention is to provide a guard structure that is lightweight and easily replaceable.

A further object of the present invention is to provide a structure that does not interfere with the movement of a boom assembly.

Yet another object of the present invention is to provide a loader cover system that allows operators to customize the appearance of the loader.

Finally, an object of the present invention is to provide a guard structure that is economical to manufacture and significantly improves the appearance of the loader.

SUMMARY OF THE INVENTION

The present invention provides an improved hydraulic cylinder and line guard. The guard protects both the hydraulic cylinder and portions of the hydraulic line while significantly removing the appearance of the hydraulic lines. While maintaining the flexibility of the hydraulic lines at pivot points, the guard inhibits the movement of the line near the cylinder thereby reducing wear on the line. The claimed invention also achieves the important objective of providing an aesthetically pleasing smooth appearance and an easily replaceable guard for hydraulic cylinders and lines.

The improved guard is achieved by utilizing a resilient guard to cover both the cylinder and the line. The guard may be formed from a single stretchable resilient tube that is deformed to enclose both the line and the cylinder, wherein a cross-section of the guard is defined primarily by combined cross sections of the cylinder adjacent to the line. The guard may also be formed from multiple interconnected resilient segments that combine to substantially enclose a hydraulic line and cylinder. The guard may further have a raised wear surface arranged in an ornamental and/or functional pattern.

These and other advantages will become apparent as this specification is read in conjunction with the accompanying drawings and claims.

BRIEF DESCRIPTION OF THE DRAWINGS

FIG. 19 is a cross-sectional view of a corrugated type hydraulic line and cylinder guard having fastening features.

FIG. 20 is a cross-sectional view of a corrugated type hydraulic line and cylinder guard having fastening features.

FIG. 23 is a cross-sectional view of a hydraulic line and cylinder guard with areas of increased thickness near the hydraulic line.

FIG. 24 is a cross-sectional view of a line and cylinder guard with areas of increased thickness near the hydraulic line.

FIG. 25 is a cross-sectional view of a hydraulic line and cylinder guard having rounded protrusions near the hydraulic line.

FIG. 26 is a cross-sectional view of a hydraulic line and cylinder guard having an axis of symmetry.

FIG. 27 is a cross-sectional view of a hydraulic line and cylinder guard having two axes of symmetry.

FIG. 28 is a cross-sectional view of a hydraulic line and cylinder guard having proportions based on the golden ratio.

FIG. 29 is a cross-sectional view of a hydraulic line and cylinder guard having a raindrop shaped cross-section.

DETAILED DESCRIPTION

The present invention may be used with any type of actuator powered by an external source. The guard of the present invention is particularly suited for applications where the actuator and lines supplying the actuator may be damaged. The improved guard may be used with actuators in and on machinery. However, for descriptive purposes, the actuator guard will be described protecting hydraulic lines and hydraulic cylinders on a front end loader.

Figure 1:
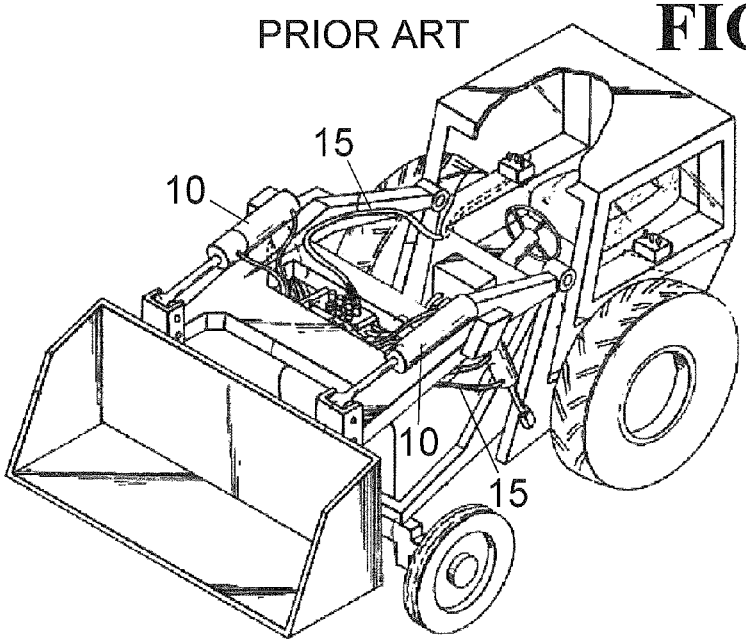
PRIOR ART FIG. 1
FIG. 1 is a side view of a loader having exposed hydraulic lines with an unrefined appearance.
Figure 2:
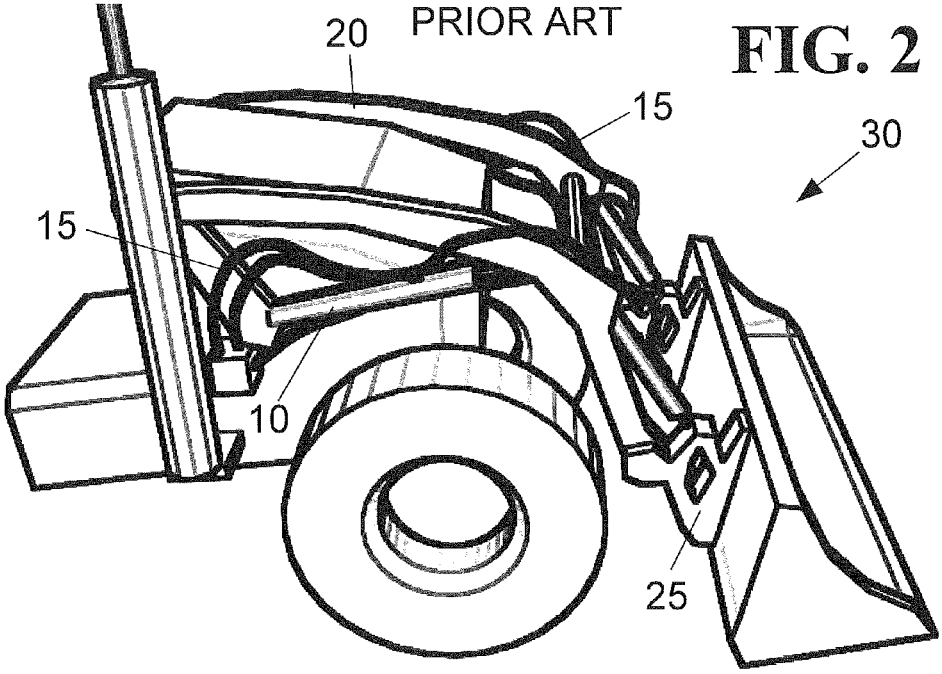
PRIOR ART FIG. 2
FIG. 2 is a side perspective view of a loader having exposed hydraulic lines with an unrefined appearance.
Figure 3:
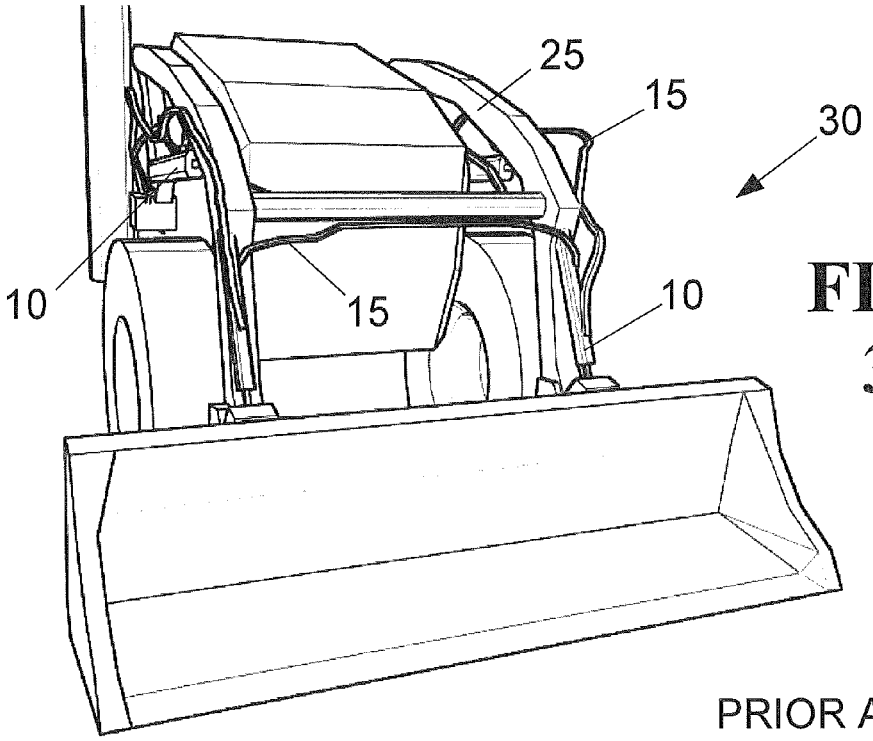
FIG. 3 PRIOR ART
FIG. 3 is a front perspective view of a loader having exposed hydraulic lines with an unrefined appearance.
Figure 4:
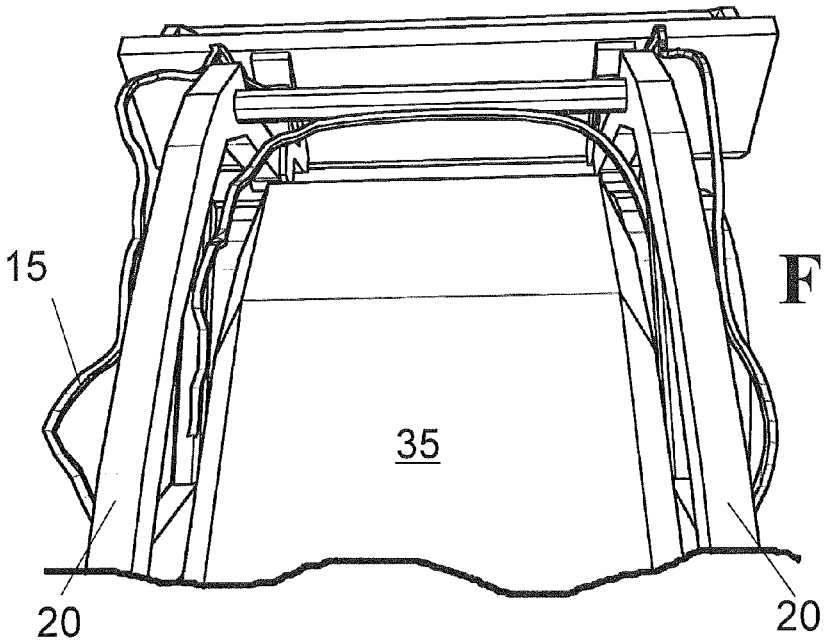
FIG. 4 is a rear perspective view of a loader having exposed hydraulic lines with an unrefined appearance.
Figure 5:
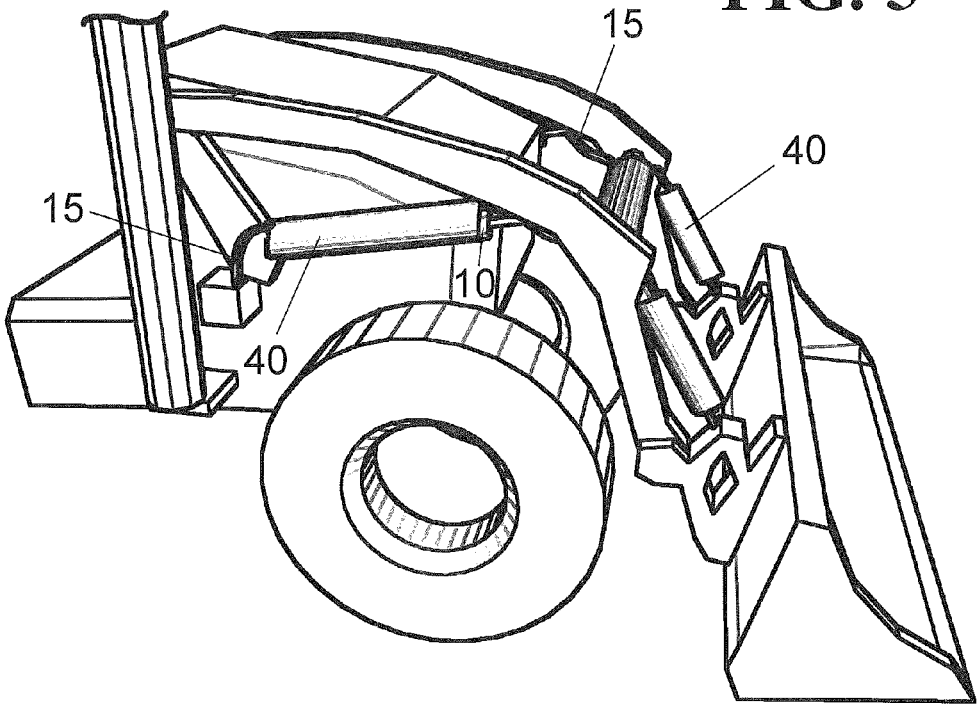
FIG. 5 is a side view of a loader having cylinders and lines surrounded by guard structures.
Figure 6:
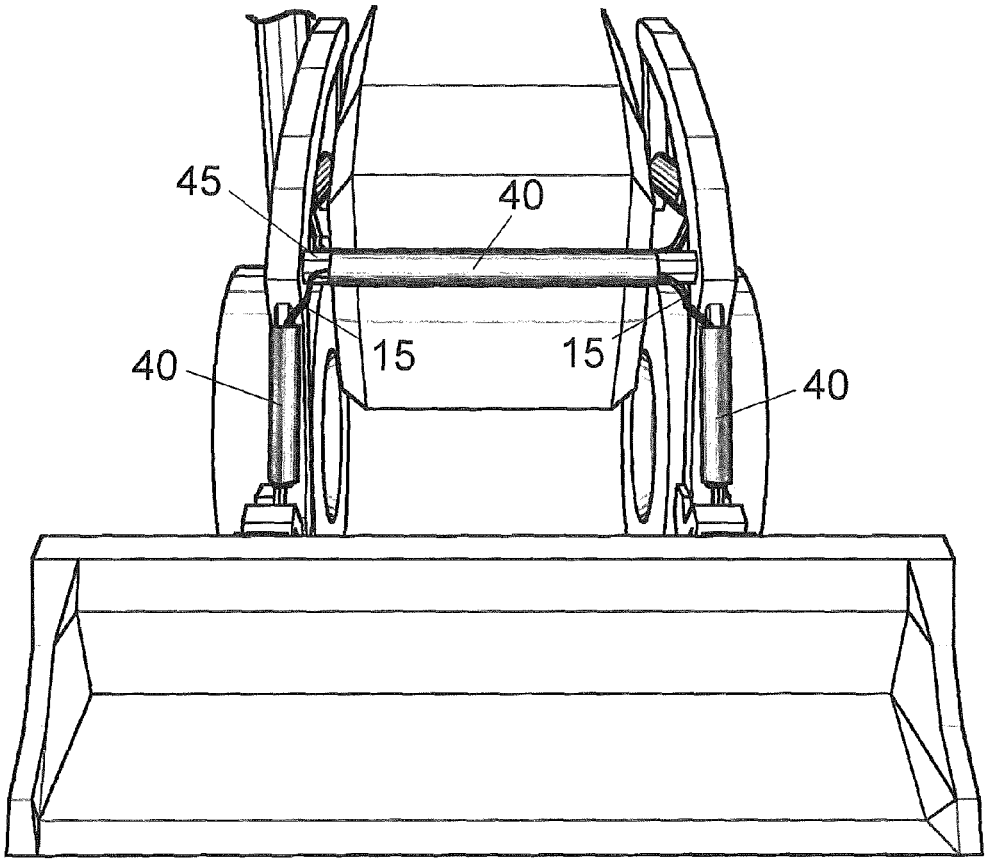
FIG. 6 is a front view of a loader having hydraulic cylinders and lines surrounded by guard structures.

As shown in FIGS. 5 and 6, the hydraulic cylinder and line guards 40 substantially surround the sides of the hydraulic cylinders 10 of the loader while also surrounding portions of the hydraulic lines 15. The guards 40 are preferably comparable in length to the cylinders that they surround so that the appearance of the lines and cylinders is minimized. The inventor also contemplates the use of multiple smaller guards or a longer guard that also covers a portion of a cylinder end.

The guards may substantially limit the movement of the surrounded portions of the hydraulic lines relative to the hydraulic cylinder. By limiting the movement of the hydraulic lines relative to the cylinders, the guard structures reduce the wear on the lines. A single guard may surround a hydraulic cylinder and more than one line. Although in the preferred embodiment of the invention, the hydraulic lines surrounded by the guards are substantially immobile relative to the guard, a guard that allows movement of the hydraulic line is within the scope of the invention. Guards that surround many lines may substantially immobilize one or more lines while allowing relatively free movement of one or more hydraulic lines.

The cylinder and line guards 40 are preferably constructed out of a resilient material such as rubbers, urethanes, and plastics. The guards are preferably constructed from an inexpensive material to facilitate replacement if the guards should become damaged or unsightly. Materials that are move flexible than the hydraulic line are preferred in order to reduce the likelihood of the guard wearing away the hydraulic line at a wear point. Additionally, constructing the guards from low cost materials facilitates replacement and specialization of the guards based on the application for which the loader is utilized. For example, highly reflective guards may be employed if the loader is used for evening street snow removal, while extra thick guards may be employed when the loader is used for clearing brush or trees.

The guards may be constructed of a material that must be stretched to fit around the hydraulic cylinder and lines. The entire guard may be constructed of a significantly stretchable material such as rubber, or portions of the guard may be rigid while other portions are stretchable. In one embodiment of the invention, the guard is made from composite materials of varying elasticities so that certain portions of the guard are able to stretch more than others.

In addition to covering hydraulic cylinders and hydraulic lines, the guards may be used to cover hydraulic lines adjacent to other features on the loader such as the cross beam between loader arms. The guards located on non-cylinder portions may be colored, textured, or ornamented similar to the guards on the hydraulic cylinders to provide a loader of refined appearance.

Figure 7:
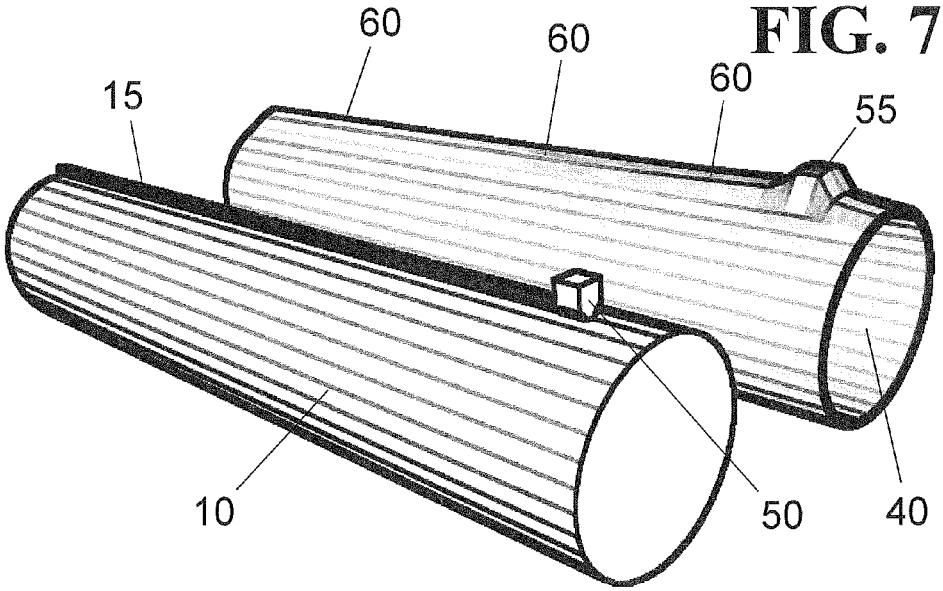
FIG. 7 is a perspective view of a hydraulic line, a hydraulic cylinder, and a guard structure of the present invention having features adapted for surrounding a hydraulic line and cylinder.
Figure 8:
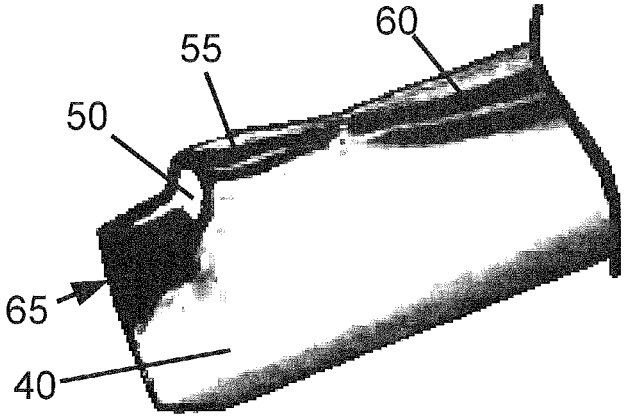
FIG. 8 is a partial perspective view of a hydraulic cylinder, fitting, and guard.
Figure 9:
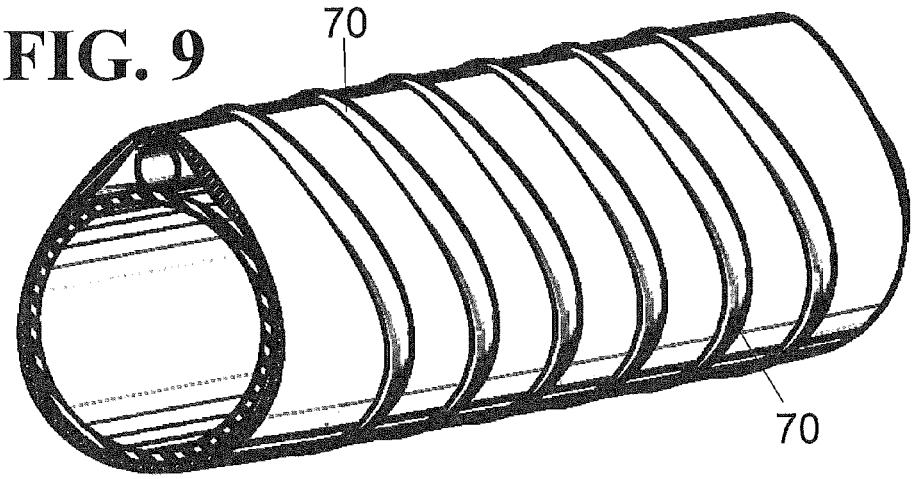
FIG. 9 is a partial perspective view of a hydraulic line and cylinder surrounded by a guard structure with a wear surface having a functional and ornamental design.
Figure 10:
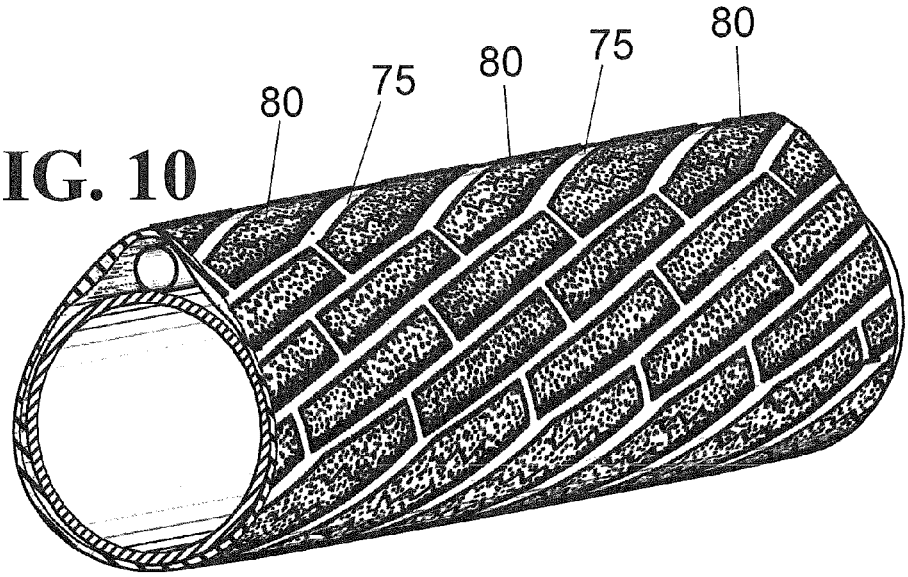
FIG. 10 is a partial perspective view of a hydraulic line and cylinder surrounded by a guard structure with a wear surface having angled grooves and protrusions.
Figure 11:
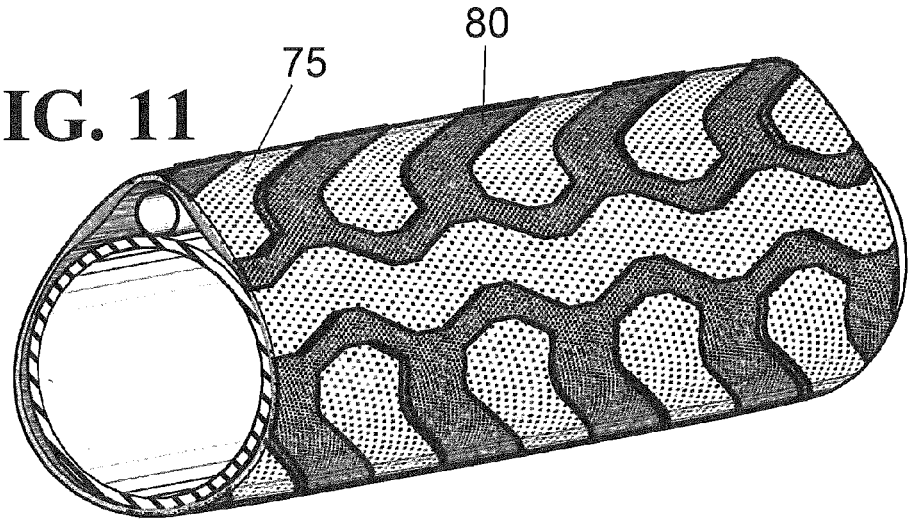
FIG. 11 is a partial perspective view of a hydraulic line and cylinder surrounded by a guard structure with a wear surface having angled grooves and protrusions.

FIGS. 7 and 8 illustrate a hydraulic cylinder 10 connected to a hydraulic line 15 by a hydraulic fitting 50. The hydraulic fitting cooperates with the hydraulic cylinder to form a substantially leak-free connection between the hydraulic line and the hydraulic cylinder. The guard 40 shown has a fitting pocket 55 adapted to cover the hydraulic fitting and a line channel 60 adapted to cover the hydraulic line. The fitting pocket and the line channel may be designed to accept a variety of fitting/line sizes, or the pocket and channel may be specifically constructed to cover a single size of fitting and line.

Although the hydraulic fitting is designed to provide a substantially leak free connection between the hydraulic line and cylinder, the quality of the connection may be degraded over time due to forces exerted upon the cylinder fitting. As shown in FIG. 8, the guard may include a fitting gap 65 to facilitate inspection of the fitting-cylinder connection.

Figure 12:
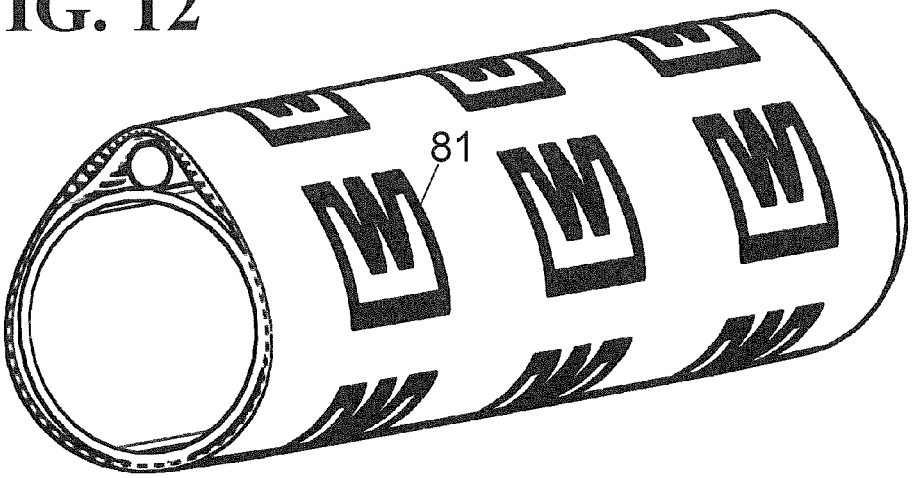
FIG. 12 is a partial perspective view of a hydraulic line and cylinder surrounded by a guard structure with a wear surface in the shape of a commercial logo.

FIGS. 9-12 illustrate guards with patterns on the exterior of the guard. The pattern 70 shown in FIG. 9 serves to provide both an ornamental design of refined appearance and a wear surface of increased thickness. The guard patterns shown in FIGS. 10 and 11, like tire tread, may have a plurality of grooves 75 and projections 80 designed to deflect material away from the hydraulic cylinder guard. As shown in FIG. 12, the projections and wear surfaces may also take the form of logos 81 or lettering on the hydraulic line and cylinder guard.

Figure 13:
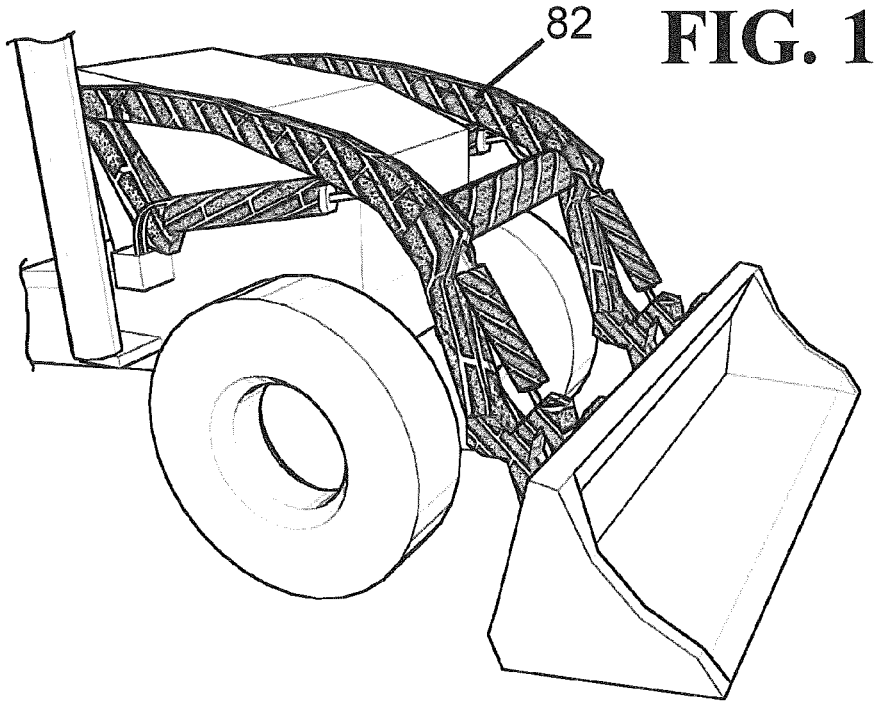
FIG. 13 is a perspective view of a loader with hydraulic lines and cylinders surrounded by guard structure with a wear surface having angled grooves and protrusions; the loader arms having a design similar in design to the guard structures.
Figure 14:
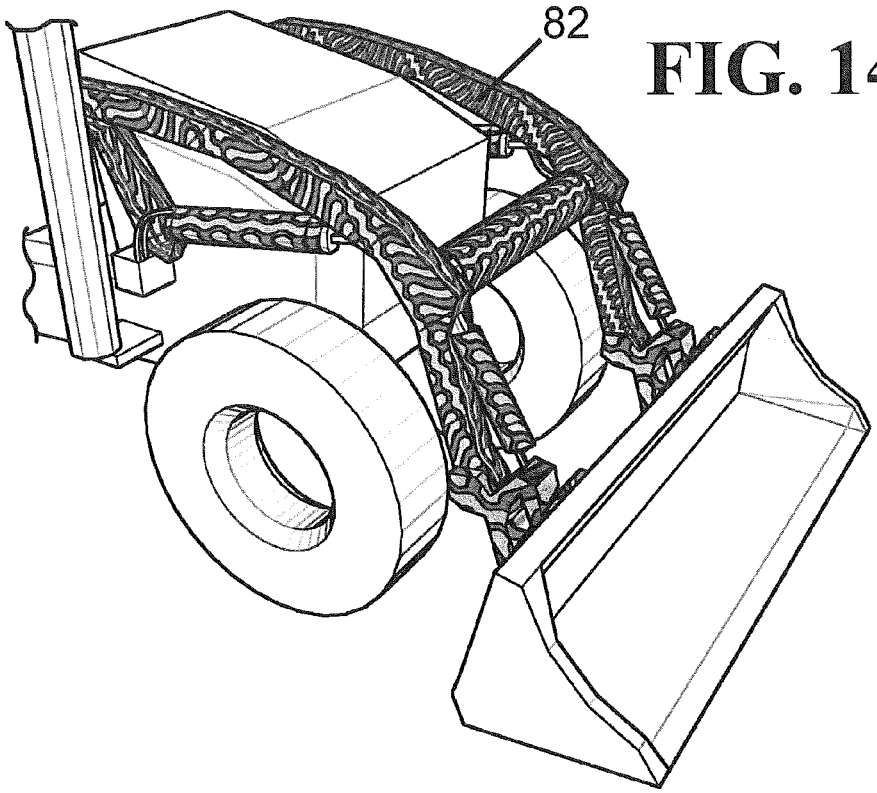
FIG. 14 is a perspective view of a loader with hydraulic lines and cylinders surrounded by guard structure with a wear surface having angled grooves and protrusions; the loader arms having a design similar in design to the guard structures.
Figure 15:
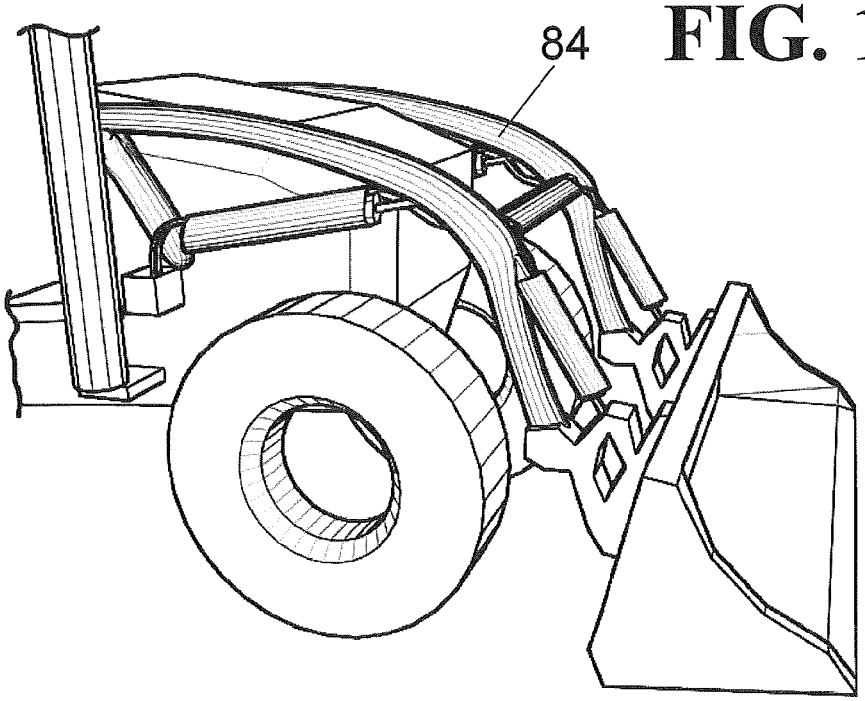
FIG. 15 is a perspective view of a loader having loader arms surrounded by guard structures.

FIGS. 13 and 14 illustrate loaders having loader arms with a decorative and functional arm pattern 82 similar in appearance to the pattern on the hydraulic line and cylinder guards. Materials used in applying the design to the loader arm may include with paint, decals, or other decorative devices. Alternatively, an arm guard 84 may be connected to the loader arms as shown in FIG. 15. The arm guard may be constructed from materials similar to those of the hydraulic line and cylinder guard or the arm guard may be constructed from lighter weight less robust materials because of the robust nature of loader arms. The loader arm guard may also primarily function to protect the loader arm from corrosion.

Figure 16:
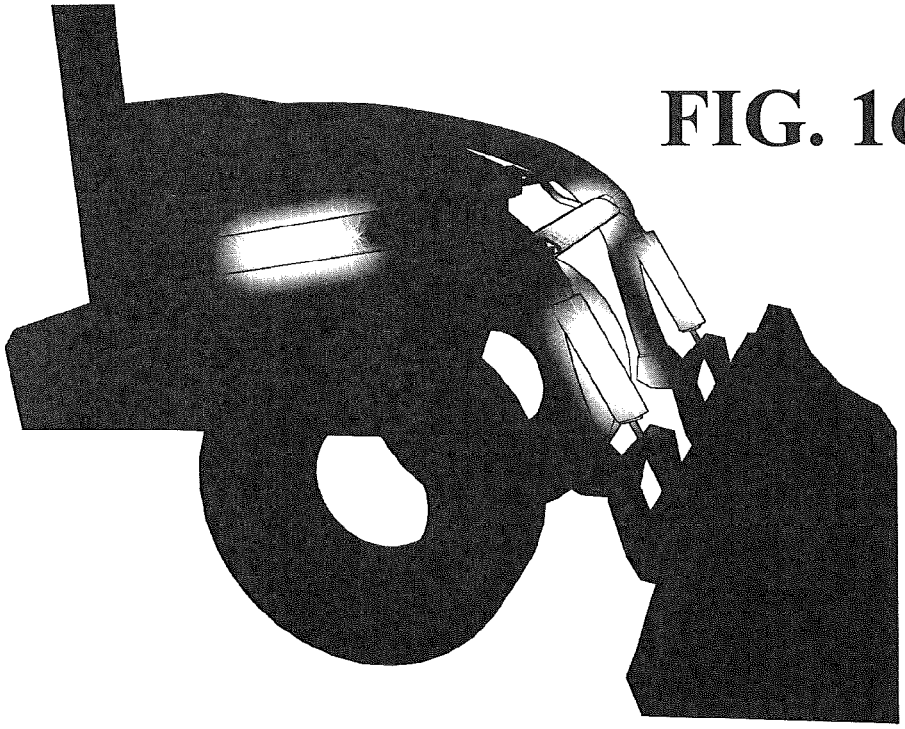
FIG. 16 is a perspective view of a darkened loader illuminated by highly reflective guard structures.
Figure 17:
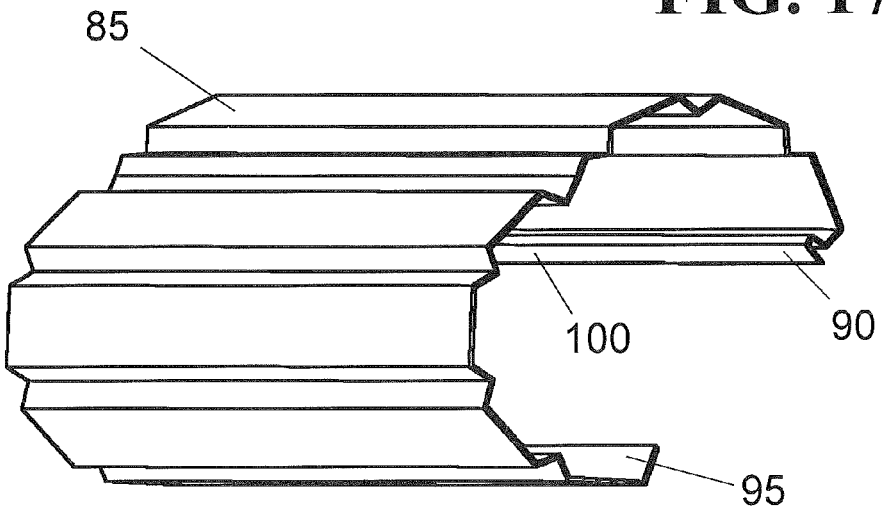
FIG. 17 is a perspective view of a corrugated type hydraulic line and cylinder guard with fastening features.
Figure 18:
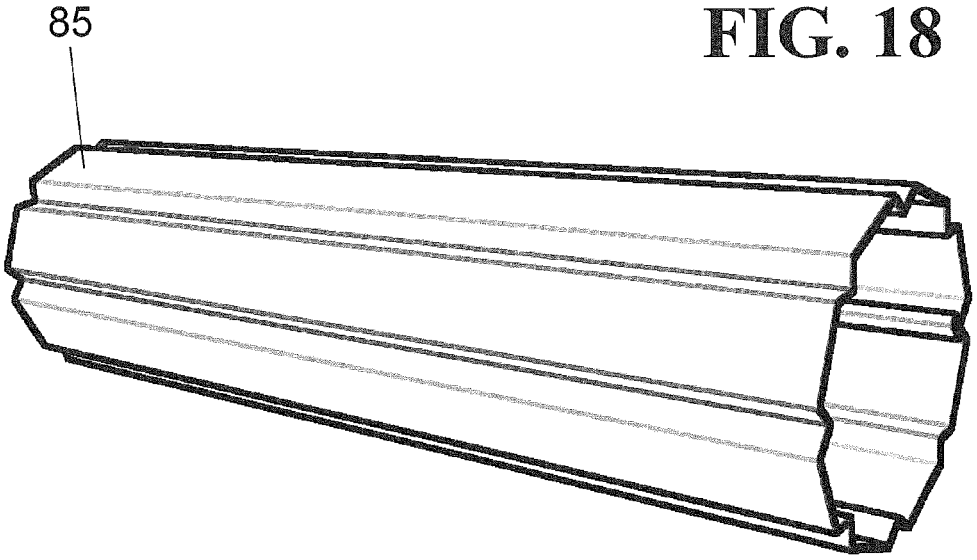
FIG. 18 is a perspective view of a corrugated type hydraulic line and cylinder guard having fastening features.

A darkened loader illuminated by highly reflective hydraulic cylinder guards is shown in FIG. 16. Reflective materials that may be used in the construction of the guard include various metals, glasses, ceramics, SilverLux™ (a product of Minnesota Mining and Manufacturing), and plastics coated with metallic layers such as silver, aluminum, and gold.

FIGS. 17-20 illustrate a hydraulic cylinder guard with a corrugated shape 85. In addition to providing a refined appearance for the hydraulic cylinder guard, the corrugated shape 85 allows the guard to compress when the guard is impacted, thus absorbing some of the force of the impact. Furthermore, the corrugated shape allows the guard to expand and surround hydraulic cylinders of various sizes.

The hydraulic line and cylinder guard shown in FIGS. 17-20 has a first connector 90 and a second connector 95 that allows the guard to be opened along a seam 100. The connectors utilized may include, but are not limited to hooks, screws, bolts, clamps, and fabric hook and loop fasteners. Guards that have lengthwise seams may be more easily installed over hydraulic cylinders and lines than seamless guards because removing the hydraulic cylinders from a loader is often a difficult process.

Figure 21:
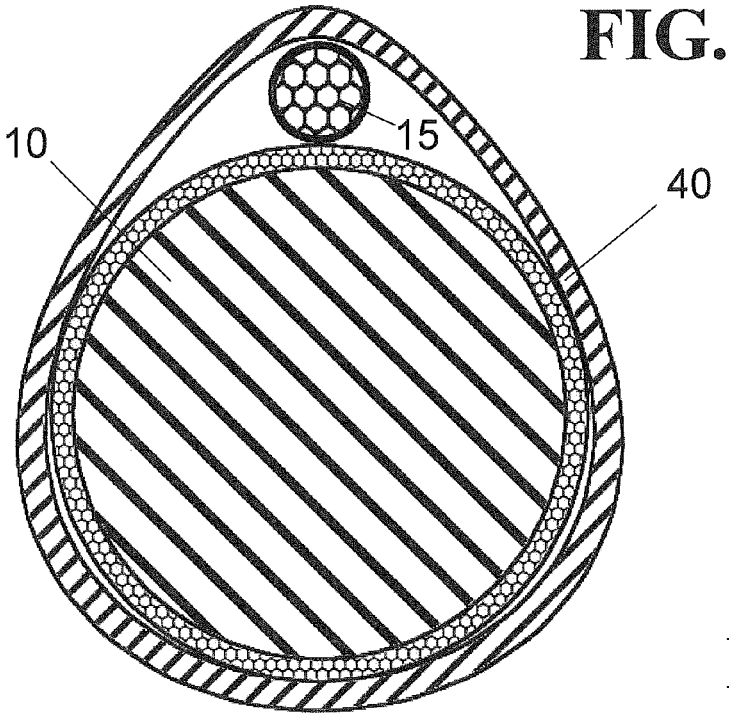
FIG. 21 is a cross-sectional view of a hydraulic line and cylinder guard surrounding a cylinder and a conduit.

FIG. 21 illustrates the cross-section of an actuator assembly with a hydraulic cylinder guard 40 surrounding a hydraulic cylinder 10 and a hydraulic line 15. The guard has a substantially uniform thickness that simplifies the manufacture of the guard. The substantially uniform thickness of the guard also simplifies installation because the guard may be placed around the hydraulic line and cylinder in any rotational orientation.

Figure 22:
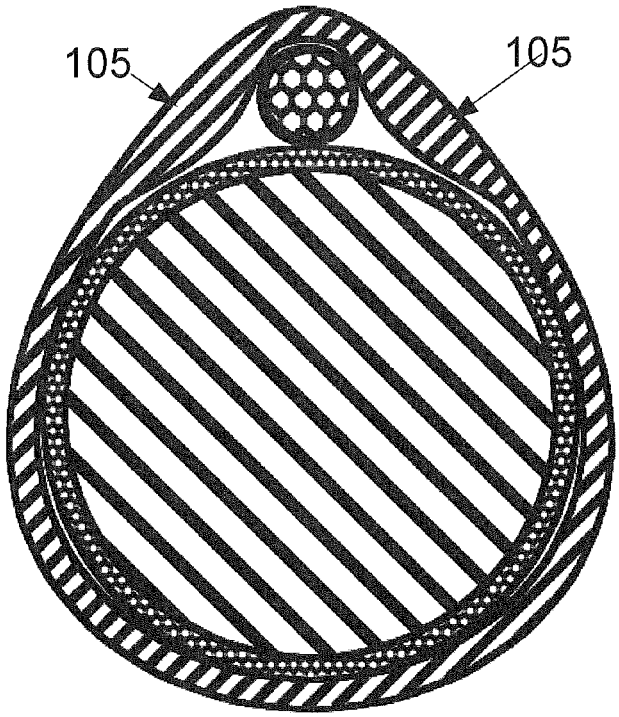
FIG. 22 is a cross-sectional view of a hydraulic line and cylinder guard with areas of increased thickness near the hydraulic line.
Figure 30:
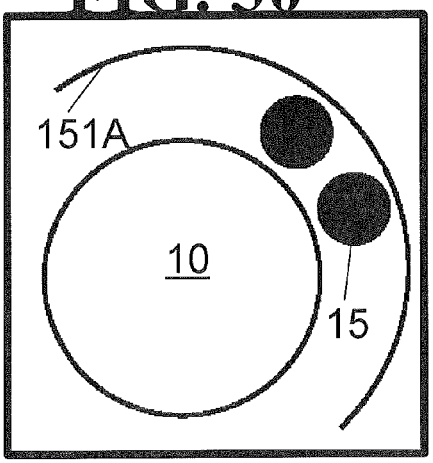
FIG. 30 illustrates an example of a semicircular hydraulic line guard with a cross-section concentric with a circular hydraulic cylinder cross section.

FIG. 22 illustrates a cross-section of a hydraulic cylinder guard having regions of increased thickness 105. The areas of increased thickness provide additional protection for the hydraulic line, and also help to limit the movement of the hydraulic line relative to the hydraulic cylinder.

FIG. 23 illustrates a cross-section of a hydraulic cylinder guard with an inner circumference 110 substantially defined by the hydraulic cylinder. The guard also has a channel 115 in which the hydraulic line is positioned. The increased surface area of the guard in contact with the hydraulic cylinder assists in preventing rotation of the guard (and hydraulic line) around the hydraulic cylinder. Additionally, the narrow channel significantly limits the movement of the hydraulic line portions within the guard. FIG. 24 shows another cross section of a hydraulic cylinder having an inner circumference substantially defined by the hydraulic cylinder. FIG. 25 illustrates a cross-section of a guard with two rounded protrusions 120 that are similar in size to the hydraulic line 15. The rounded protrusions cooperate to form a groove in the guard that limits the movement of the hydraulic line.

FIGS. 26 and 27 illustrate line and cylinder guards where a first axis of symmetry 125 and a second axis of symmetry 130 contribute to the refined appearance of the guard. Symmetry is often associated with an aesthetically pleasing appearance. In addition to having ornamental value, the axes of symmetry facilitate manufacture of the guard. For example, less tooling may be required to produce a highly symmetrical line and cylinder guard than an unsymmetrical guard. Installation of the guard is also facilitated because highly symmetrical guards may be installed in a variety of orientations.

FIG. 28 illustrates a guard with cross-sectional proportions based on the golden ratio. The guard has a longest radius 135 (as measured from the center of the hydraulic cylinder) and a shortest diameter 140 that are in a ratio of approximately 1:1.618, commonly referred to as the golden ratio. The golden ratio has been attributed to an aesthetically pleasing appearance and is found in Renaissance art and architecture, such as works by Leonardo Da Vinci. Additionally, the golden ratio has been attributed to the geometry of the Pyramids of Giza and the Parthenon. In another embodiment of the invention, the longest radius and a perpendicular radius form two sides of a golden triangle.

FIG. 29 illustrates a hydraulic line and cylinder guard having a raindrop shaped cross-section 145. In addition to providing an aesthetically pleasing shape based on nature, the pointed section 150 of the raindrop shaped guard helps to deflect falling objects away from the hydraulic cylinder and line. The increased thickness of the guard at the pointed section relative to the average thickness further serves to absorb and disperse the force of an object impacting on or near the hydraulic line.

Figure 31:
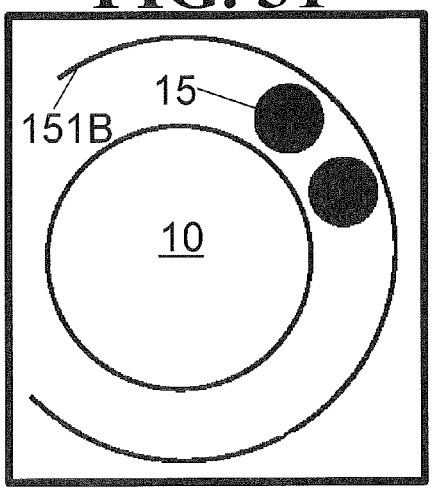
FIG. 31 illustrates an example of a line cover concentric with a circular hydraulic cylinder, wherein the line cover extends 270 degrees around the center of the hydraulic cylinder.
Figure 32:
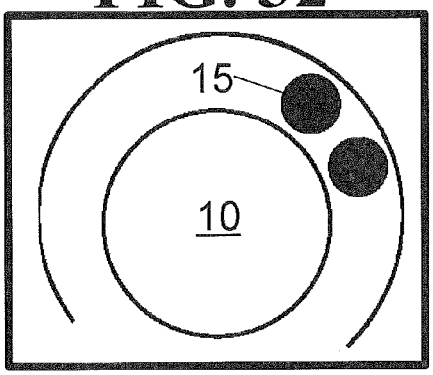
FIG. 32 illustrates another example of a hydraulic line guard concentric with a circular hydraulic cylinder wherein the line cover extends approximately 270 degrees about the hydraulic cylinder.
Figure 33:
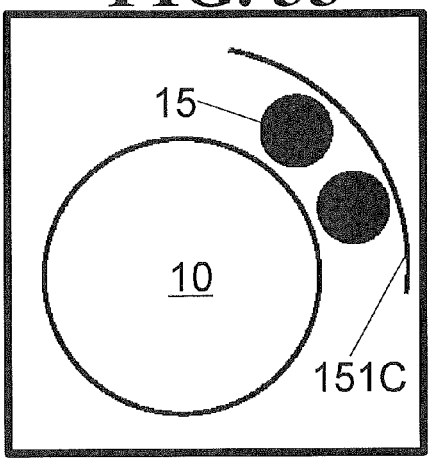
FIG. 33 illustrates a hydraulic line guard concentric with a circular hydraulic cylinder wherein the line cover extends approximately 90 degrees around the center of the hydraulic cylinder.

FIGS. 30 through 33 show cross sections of transmission line guards 151A to 151C that are concentric with round hydraulic cylinders 10. In the illustrated examples, the diameters of the transmission line guards are substantially equal to the diameter of the hydraulic cylinder plus twice the diameter of the hydraulic lines 15. The half circle guard 151A shown in FIG. 30 can be easily installed or removed from the hydraulic cylinder since it only covers half of the loader. The 270 degree circle guard 151B shown in a FIGS. 31 and 32 provides more protection to the hydraulic lines by enclosing them more, while still maintaining some of the ease of installation of the half circle guard. Additionally, more hydraulic lines are able to fit into the area protected by the 270 degree guard. If the 270 degree circle guard is slightly flexible, it may be possible to remove the guard without having to disassemble the hydraulic cylinder. FIG. 33 shows a 90 degree circle guard 151C that allows for inspection/repair of the hydraulic lines without removal of the guard. The 90 degree circle guard does not provide as much protection to the hydraulic lines as the half circle or 270 degree guards, so the 90 degree guard is primarily adapted for cylinders that are unlikely to be impacted by foreign objects.

Figure 34:
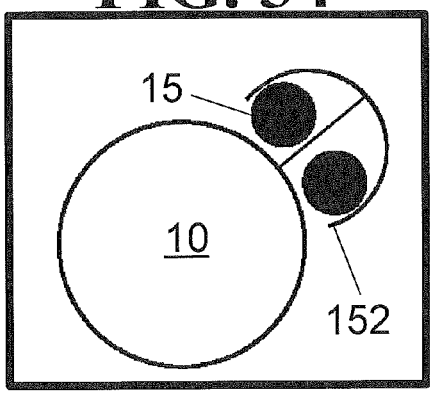
FIG. 34 illustrates a hydraulic line guard having a semicircular cross section, wherein the radius of curvature of the guard is substantially less than the radius of curvature of the hydraulic cylinder.

FIG. 34 illustrates an example of a small semicircular guard 152 with a diameter that is substantially less than the diameter of the hydraulic cylinder. Having a smaller diameter, the small semicircular guard 152 is able to wrap around the hydraulic lines 15 and provide somewhat more protection to the lines than 90 degree guard shown in FIG. 33. By wrapping around the hydraulic line, the small semicircular guard is able to substantially limit the movement of the hydraulic lines relative to the hydraulic cylinder thereby reducing the amount of wear on the lines.

Figure 35:
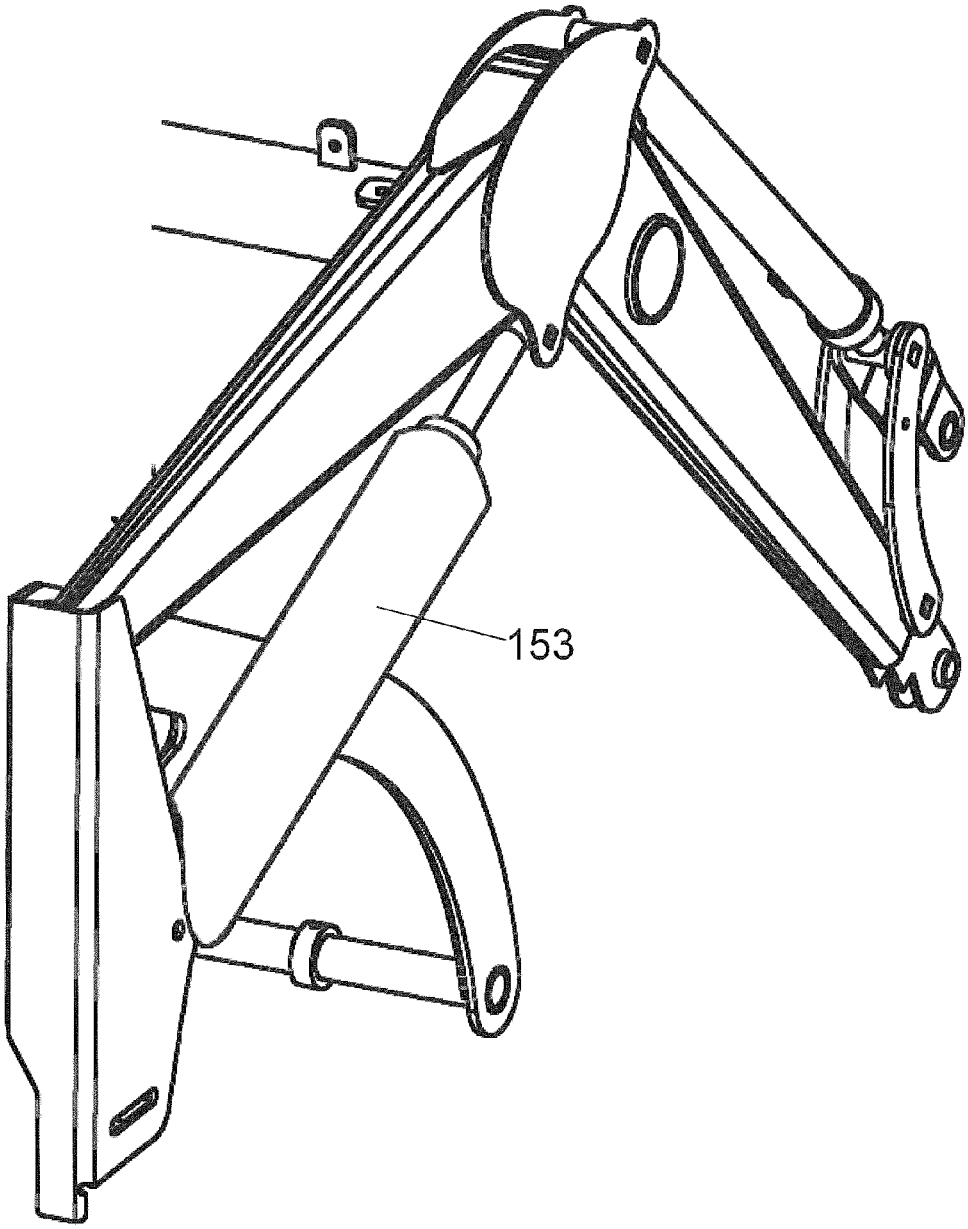
FIG. 35 shows a perspective view of a semicircular hydraulic cylinder guard that hides hydraulic fluid transmission lines.
Figure 36:
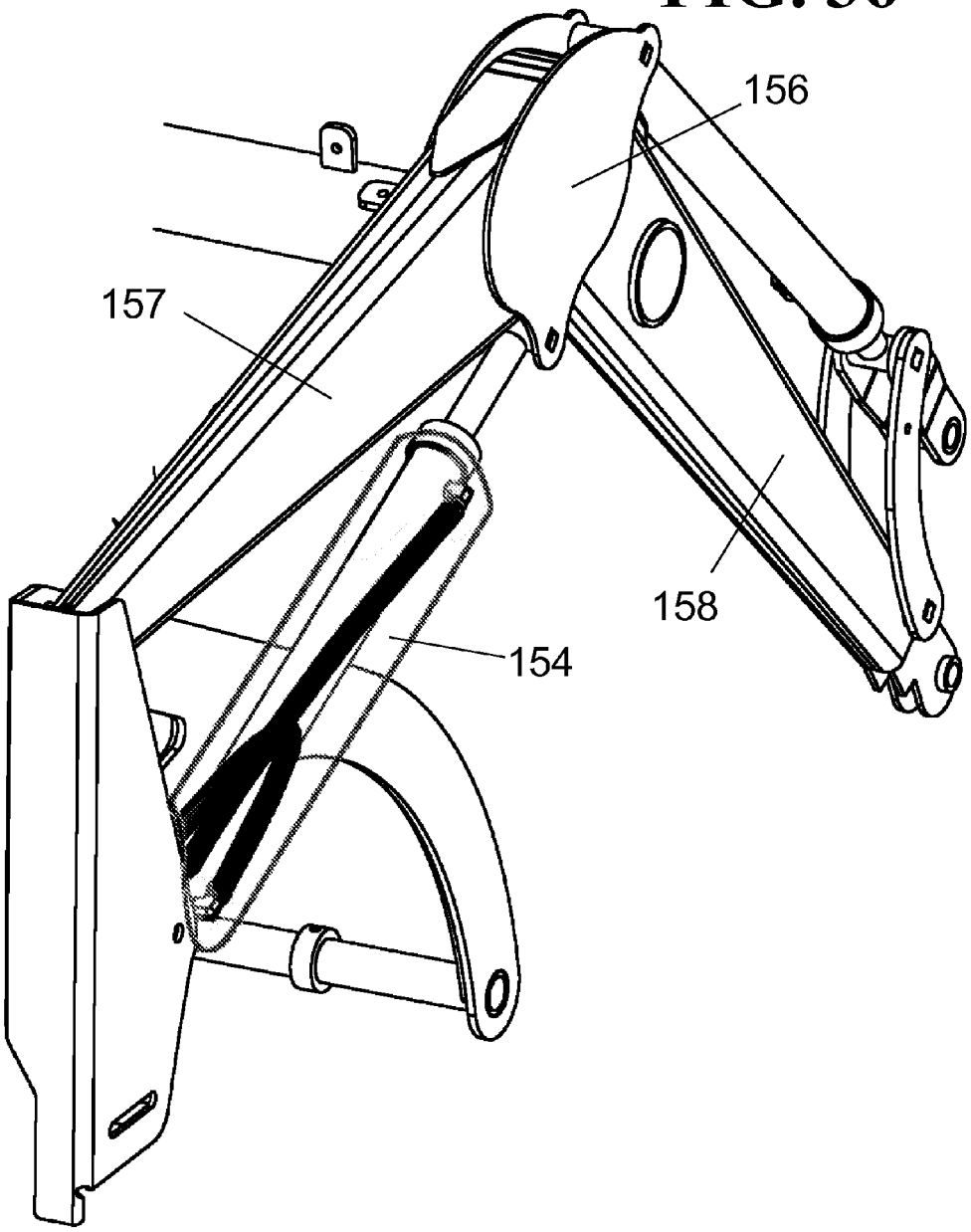
FIG. 36 shows a perspective view of a transparent or translucent semicircular hydraulic cylinder guard that facilitates inspection of protected hydraulic transmission lines.

FIGS. 35 and 36 show an opaque semicircular guard 153 and a transparent semicircular guard 154 protecting transmission lines and hydraulic cylinders on a loader. The transparent guard 154 allows for easy inspection of the hydraulic lines, while the opaque semicircular guard 153 hides the lines and provides the loader with a more refined appearance. Semi-transparent or tinted guards may also be used to provide the loader with a refined appearance while also allowing for inspection of the lines while the guard is installed. FIG. 36 illustrates a loader arm having a curved region 156, a first portion 157 between the curved region 156 and the loader, and a second portion 158 between the curved region 156 and the implement.

Figure 37:
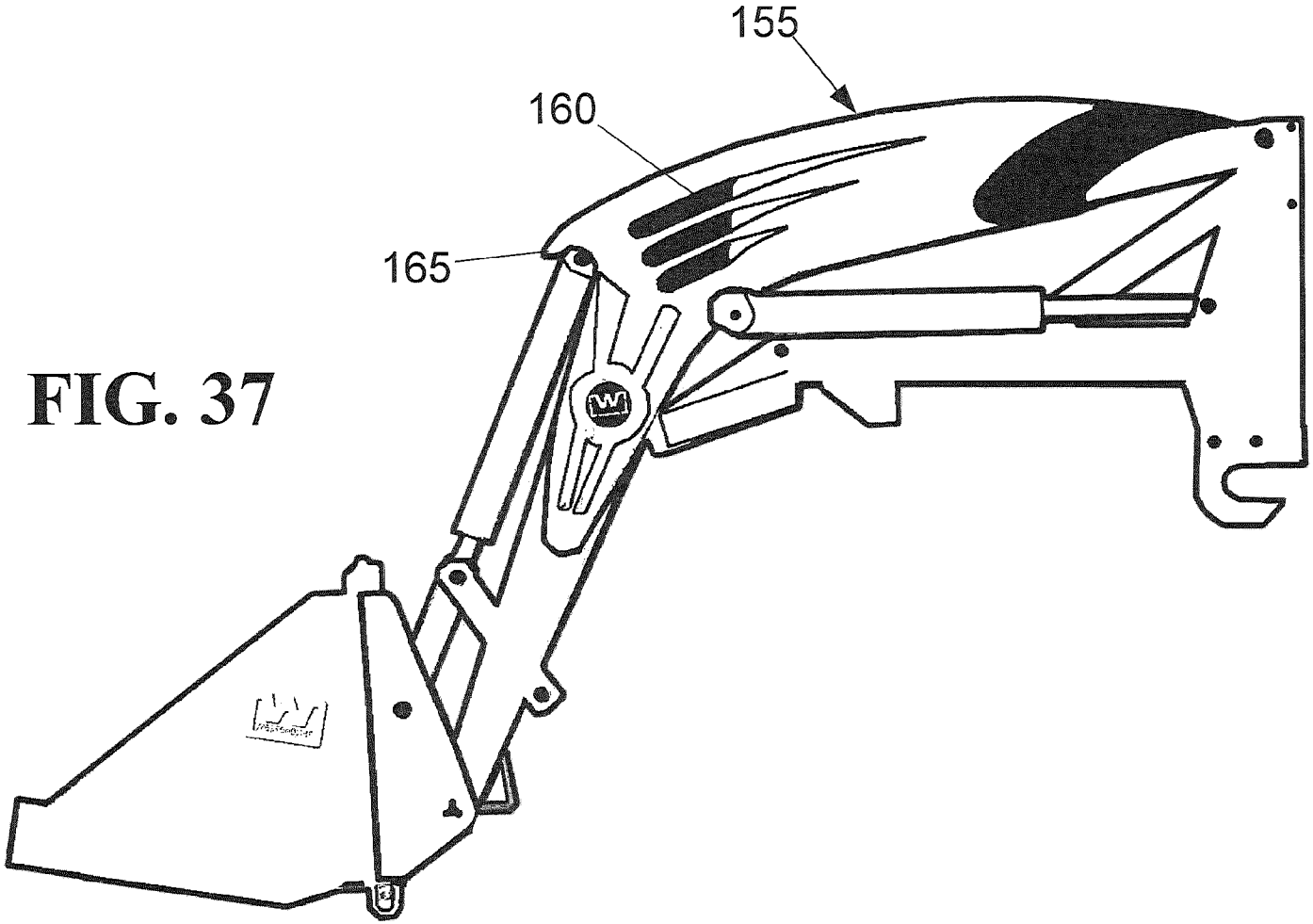
FIG. 37 is side view of a hydraulic line protector connecting to a loader arm.
Figure 38:
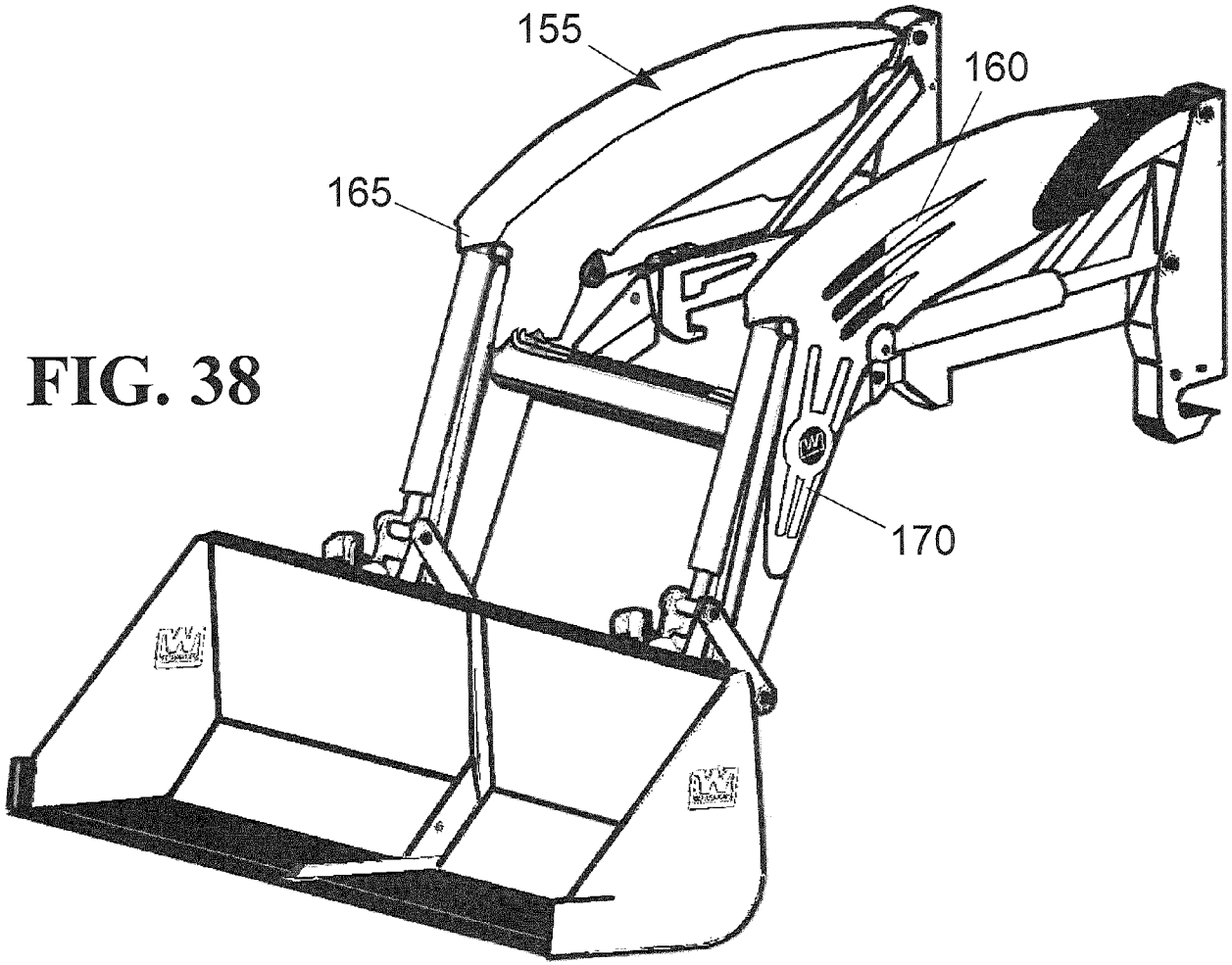
FIG. 38 is a perspective view of two hydraulic line protectors with wear surfaces and line access vents.

FIGS. 37 and 38 illustrate hydraulic line protectors 155 surrounding portions of loader arms. The hydraulic line protectors have access vents 160 to facilitate inspection of the hydraulic lines. These vents may be holes in the hydraulic line protectors or sections of translucent material. The shape and the arrangement of the access vents may be both ornamental and functional as shown in FIGS. 37 and 38. The hydraulic line protectors 155 may also include features and slots 165 adapted to be near hydraulic cylinders. The slots 165 may include cut-away areas that prevent the cylinders from wearing upon the hydraulic line protectors. Features such as reinforced overhangs may be used shield portions of the cylinders from dirt and rain. In addition to features designed to protect the hydraulic cylinder and lines, easily replaceable lateral wear surfaces 170 may protect the loader arms and the hydraulic line protector itself.

Figure 39:
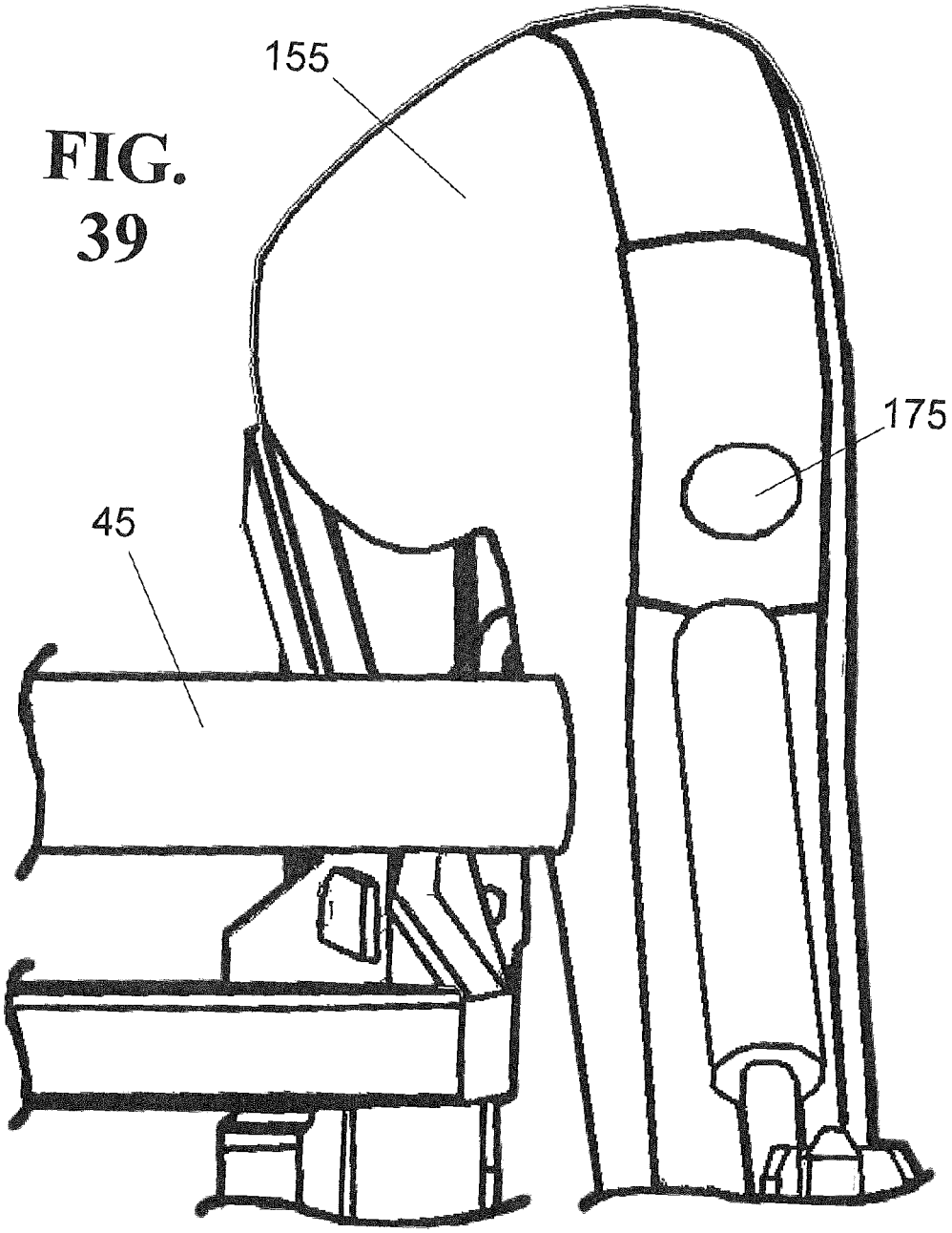
FIG. 39 is a partial front view of a hydraulic line protector connecting to a loader arm.

FIG. 39 is a partial front view of a hydraulic line protector 155 with a removable access panel 175 that facilities inspection and repair of hydraulic lines. The removable access panel also protects the hydraulic lines from foreign objects, dirt, and debris that may damage or corrode portions of the hydraulic lines. The access panel 175 may also be in an ornamental yet functional shape.

Figure 40:
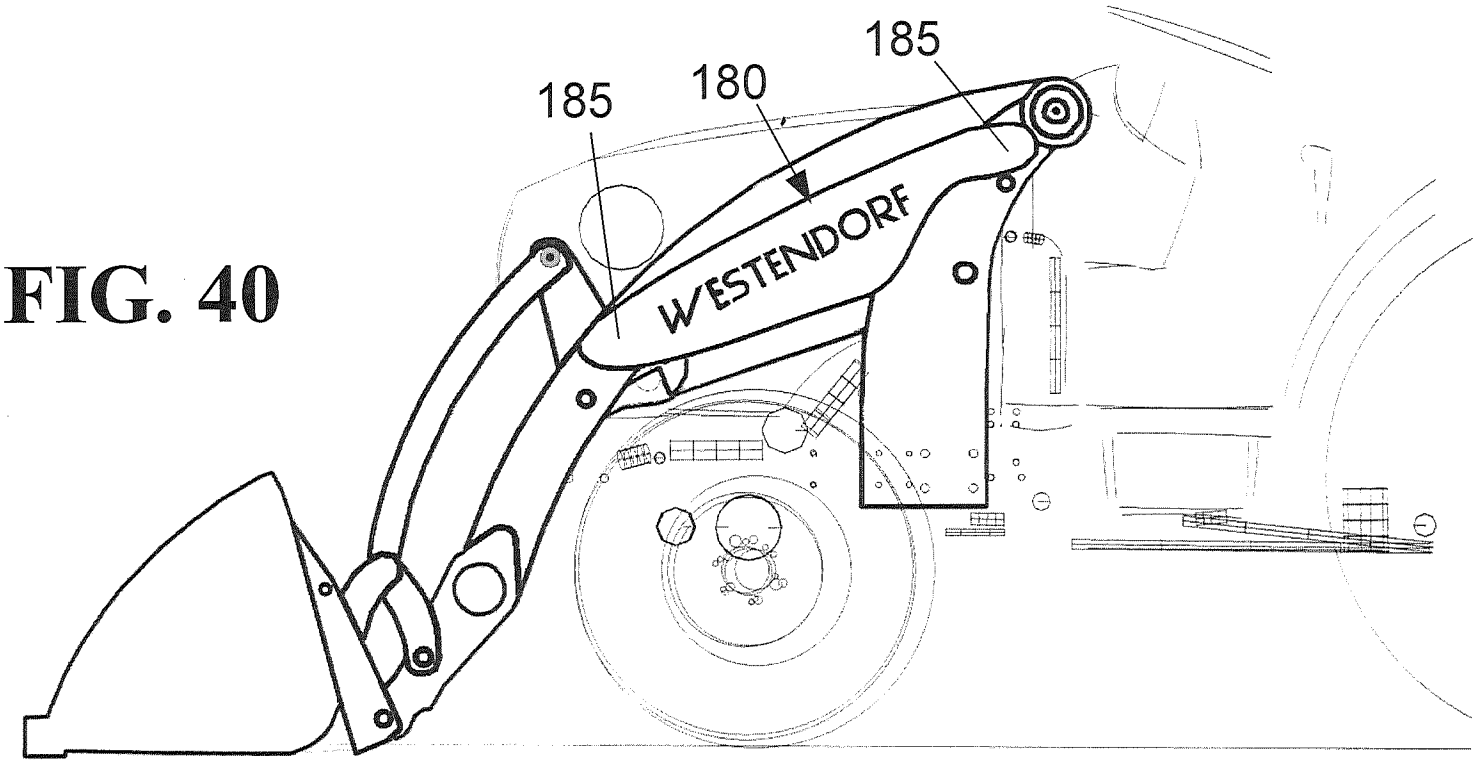
FIG. 40 is a side view of a hydraulic line and cylinder protector connecting to two articulated sections of a loader.

FIG. 40 is a side view of a lateral protector 180 attached to the lateral surfaces of two articulated loader arm sections. The lateral protector is connected to the two sections of the loader arm at pivot points 185 that may include rotatable portions welded onto existing loader arms. Because installation of the lateral protector does not require the loader arms be disassembled, a variety of loaders may be retrofitted with these devices. In order to increase the number of loaders compatible with a single design of lateral protector, the protector may have expansion features such as those shown in FIGS. 34 and 35.

Figure 41:
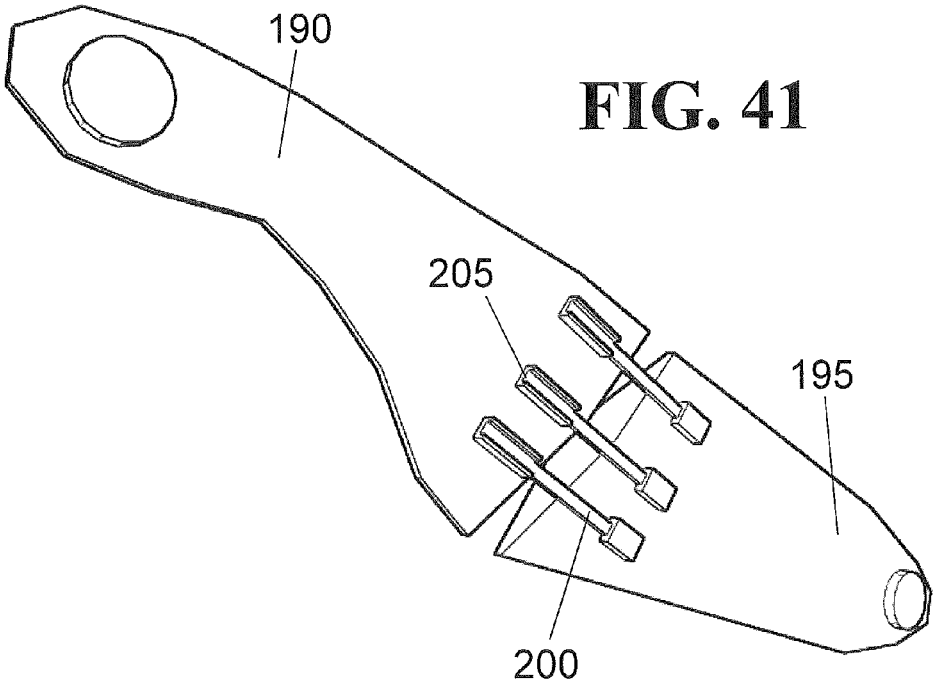
FIG. 41 is a side view of a hydraulic line and cylinder protector having expansion joints.
Figure 42:
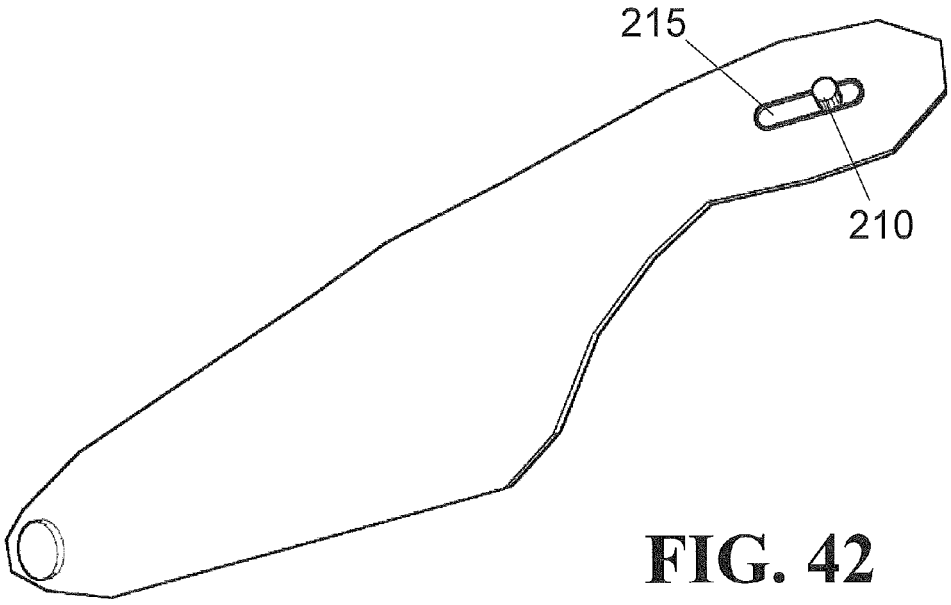
FIG. 42 is a side view of a hydraulic line and cylinder protector having a slidable pivot point.

FIG. 41 shows a lateral protector with a first section 190 that is separable or slidable relative to a second section 195. The two sections may be secured together by an expansion mechanism having rods 200 connected to and moveable relative to a receiving device 205. In addition to allowing the lateral protector to be connected to a greater variety of loader arms, the expansion device may help to prevent stretching of the lateral protector when the loader arms are operated. A lateral protector with a moveable pivot 210 slidable along a track 215 is shown in FIG. 42. The moveable pivot provides functionality similar to the expansion device of FIG. 41.

Figure 43:
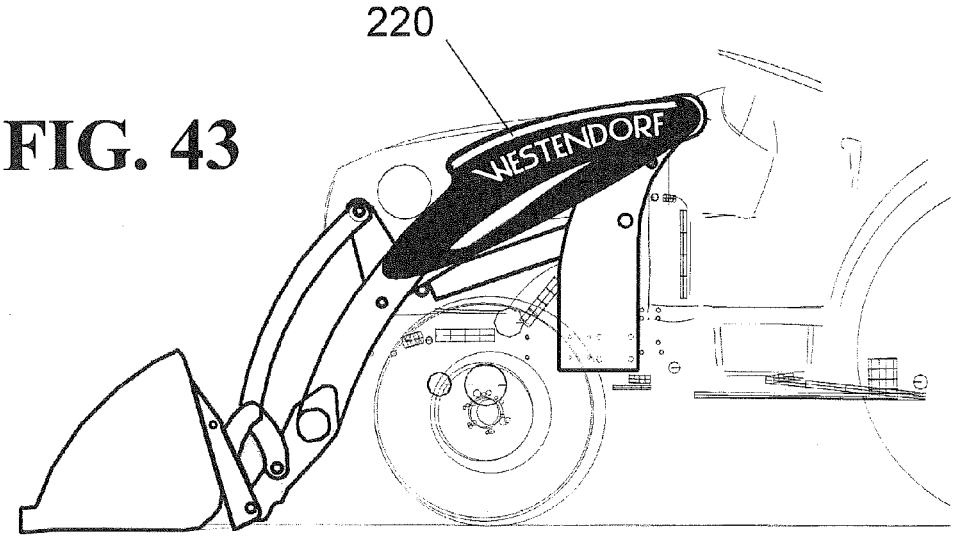
FIG. 43 is a side view of a hydraulic line cover connected to a loader arm.
Figure 44:
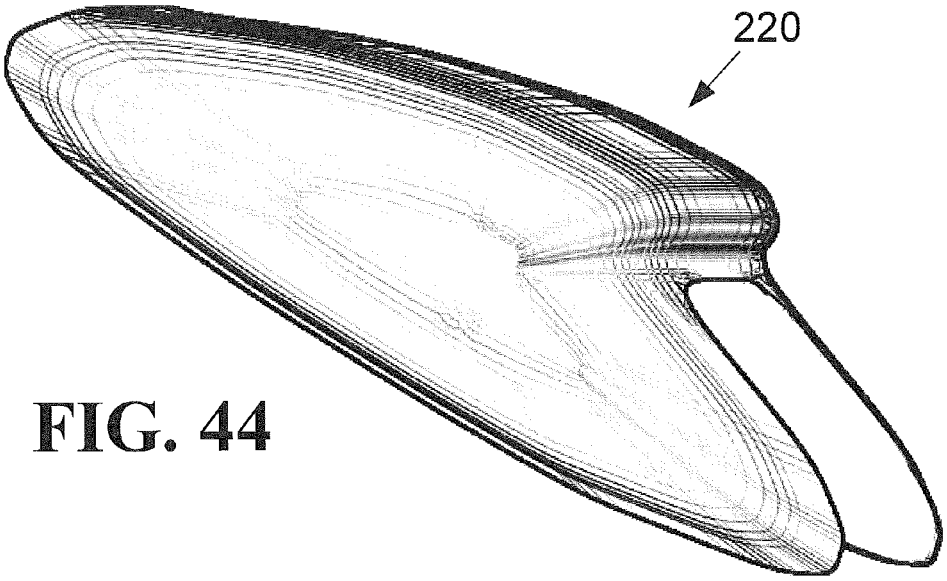
FIG. 44 is a perspective view of a hydraulic line cover.

FIGS. 43 and 44 show a hydraulic cover 220 for loader arms, hydraulic cylinders, and hydraulic lines. The illustrated cover is attached to a single non-actuating portion of a loader arm. The hydraulic cover may surround the loader arm on three sides, or the cover may only protect a single side.

Figure 45:
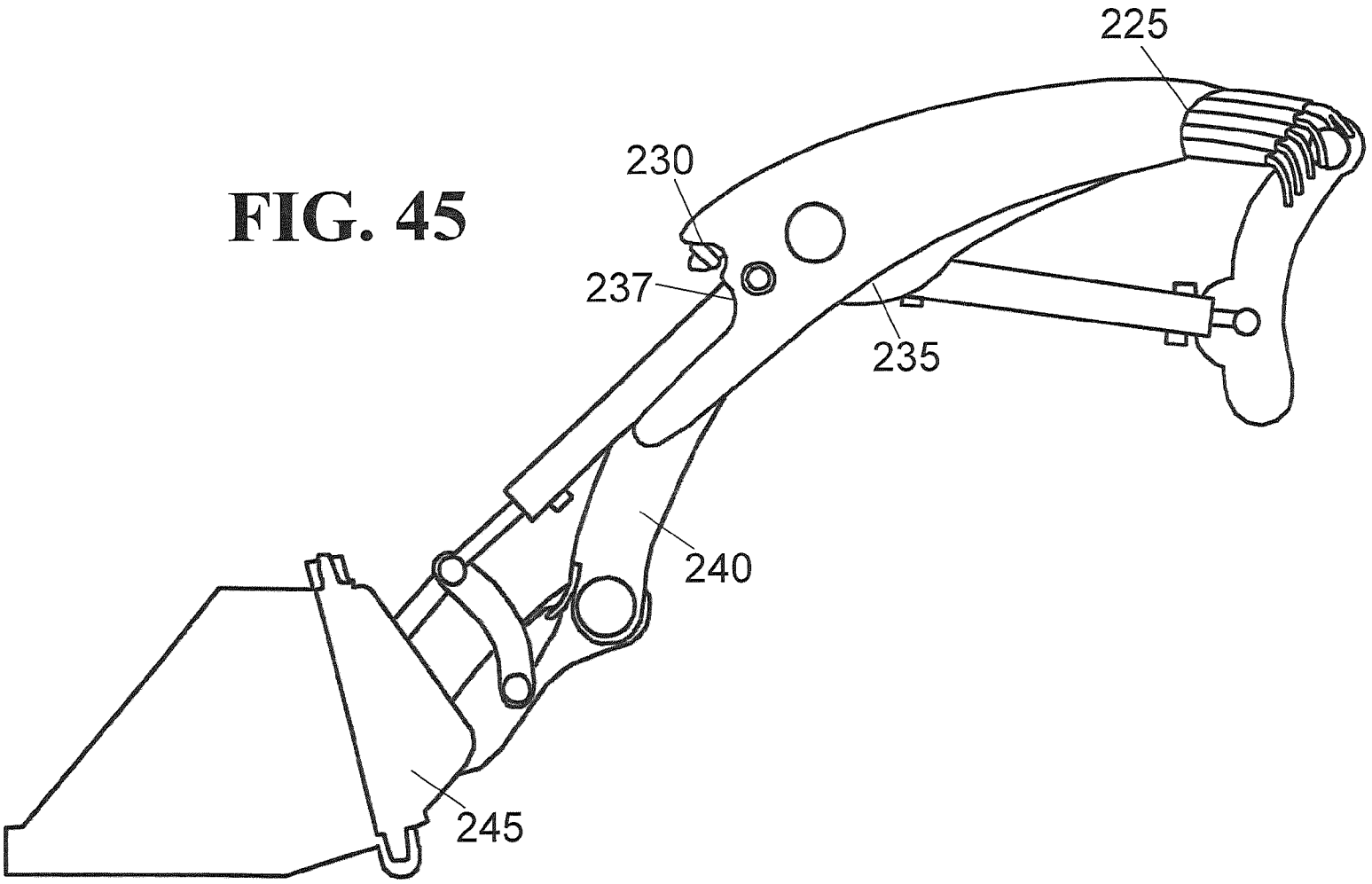
FIG. 45 shows a side view of a loader arm cover that protects both the loader arm and the hydraulic fluid transmission lines while also providing a refined appearance to the loader.

FIG. 45 shows a loader cover system with an arm guard having a rounded line accepting section 225 adapted for accepting a plurality of transmission lines, a rounded light section 230 adapted for receiving and protecting a light on the loader, and a first curved joint section 235 adapted for receiving a hinge of a first hydraulic cylinder, and a second curved joint section 237 adapted for receiving a hinge of a second hydraulic cylinder. The combination of the rounded features (225, 230, 235, and 237) of the arm guard serve to visibly soften the stark connections between the various moving parts of the loader arm thus providing a smooth and refined appearance to the loader arm. By hiding some of the joints of the loader arm, the loader cover also helps to prevent dirt and debris from affecting the joints. The rounded line accepting section 225 also reduces the wear on the hydraulic transmission lines when the loader arm is raised and lowered. In addition to providing a refined appearance, the light section forms a protective pocket that helps shield the light from objects that may damage it. The loader cover system also includes a joint section 240 that helps protect lines extending to the bucket region. As with the other aspects of the loader cover system, the joint section helps to provide a refined appearance to the loader. An implement guard 245 is secured to the bucket.

Figure 46:
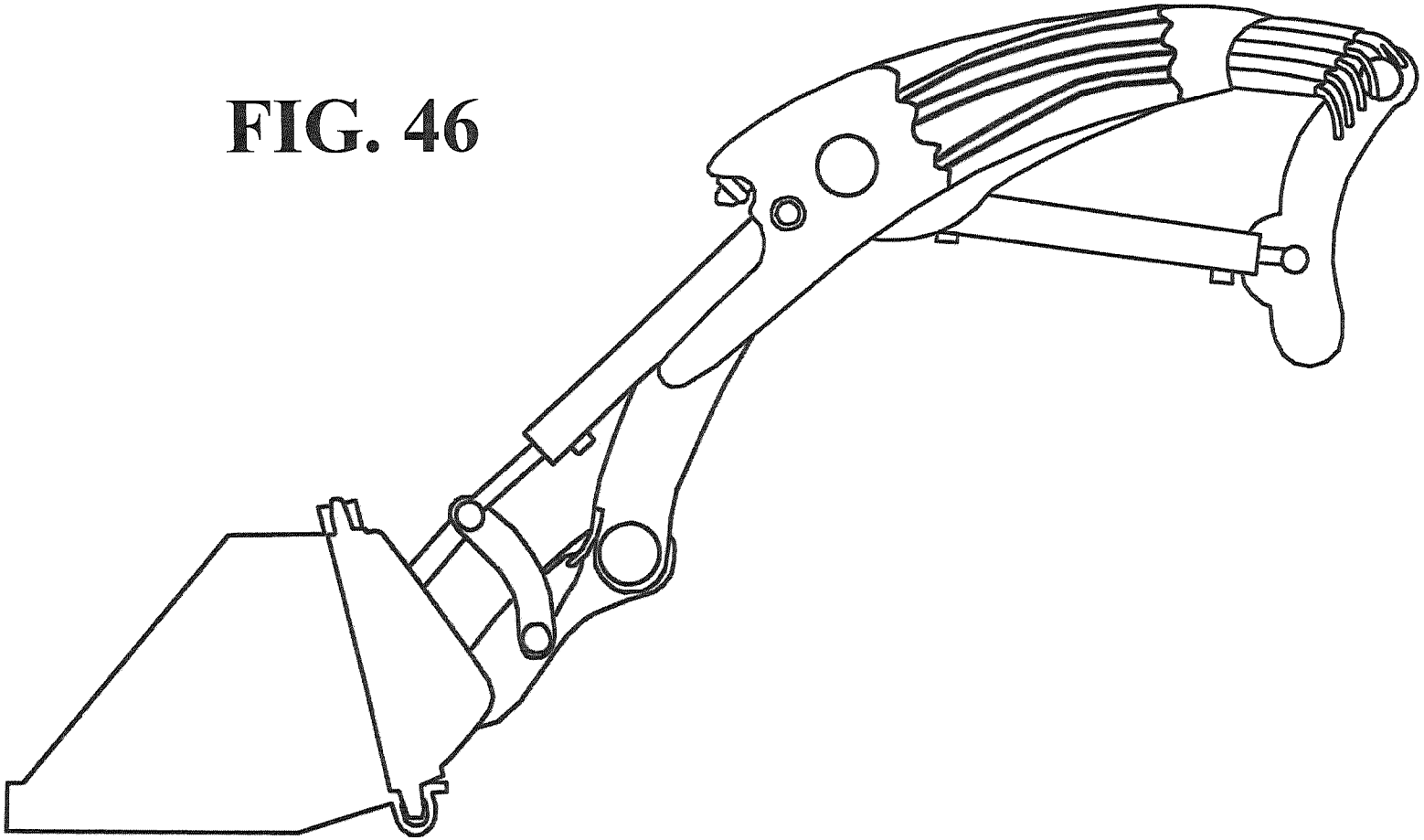
FIG. 46 shows a cutaway view of a loader arm cover where the protected hydraulic lines are shown.
Figure 47:
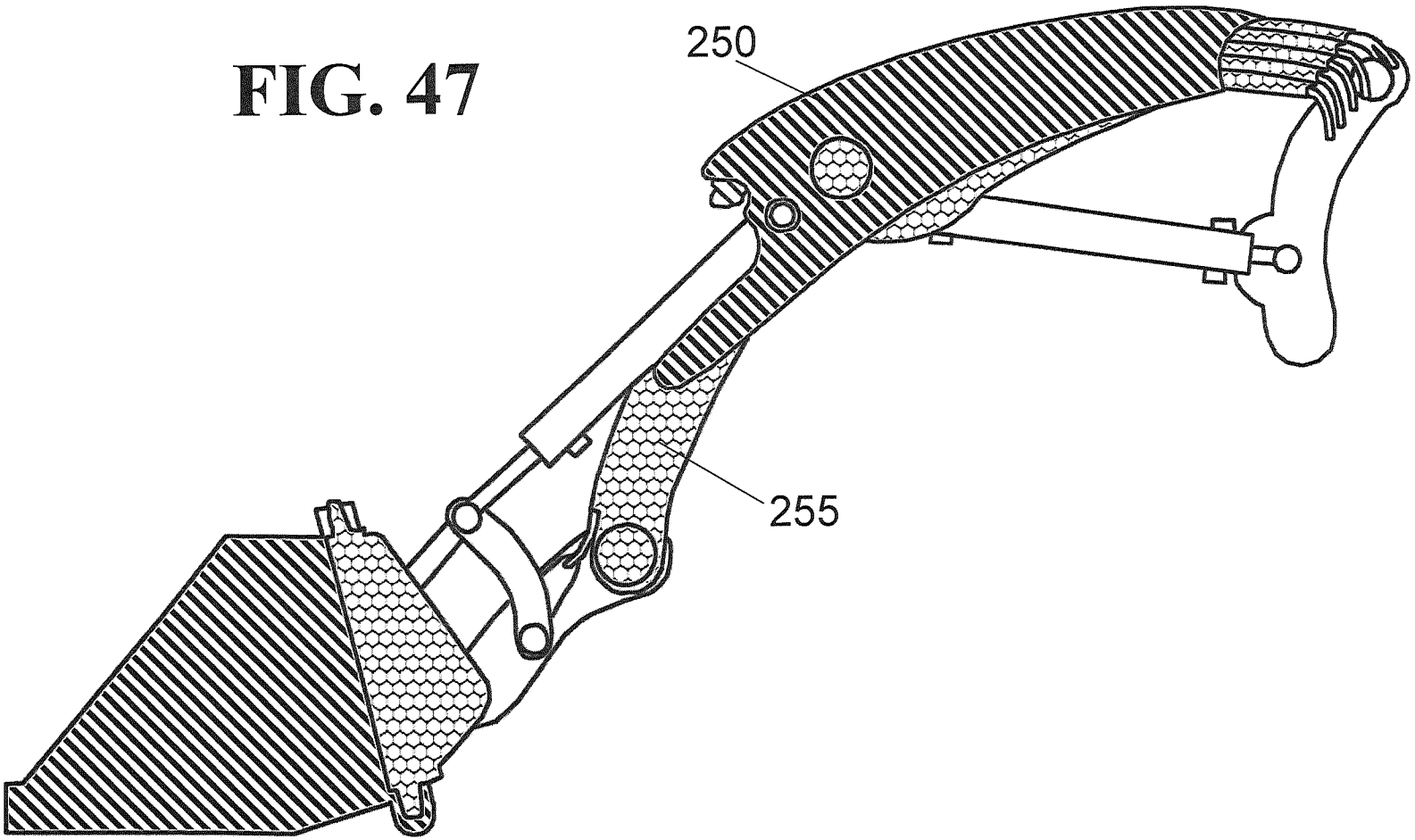
FIG. 47 shows an example of a cover system with portions having a first color or texture and another set of portions having a second color or texture.
Figure 48:
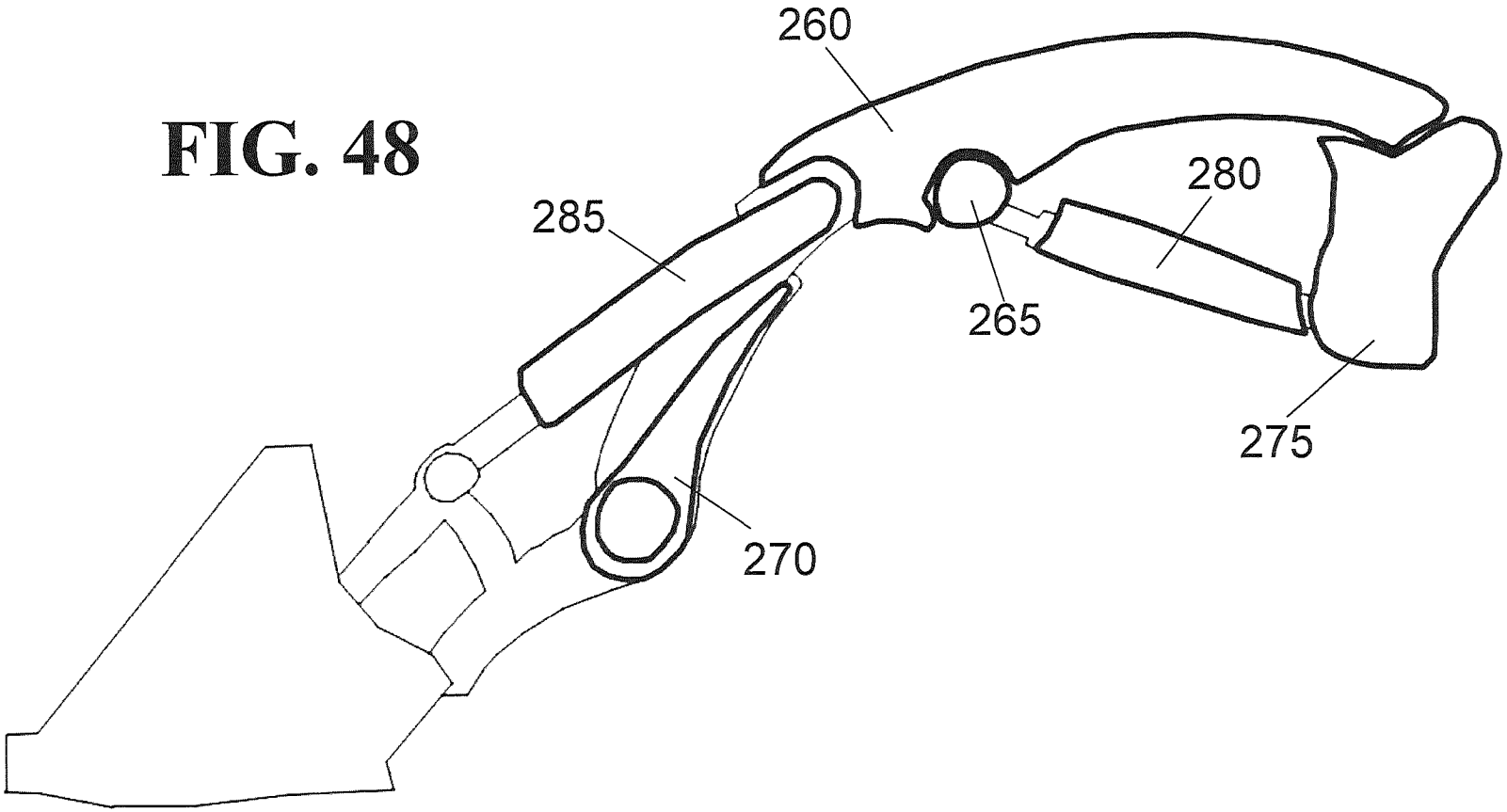
FIG. 48 shows a side view of a substantially modular loader arm and cylinder cover system.

FIG. 46 shows the loader cover system of FIG. 45 with a section cut away to reveal the lines that are protected by the loader arm cover. FIG. 47 illustrates a loader cover system where two or more colors or textures are used to provide the loader with a refined appearance.

FIGS. 48-51 show segmented cover systems with an arm cover portion 260, an arm joint cover portion 265, a bucket joint portion 270, a base portion 275, an arm cylinder cover portion 280, and a bucket cylinder cover portion 285. The portions of the cover system are adapted to be individually replaced if one portion becomes damaged or distorted. In the illustrated example of a segmented loader cover system, the covers are substantially smooth and hide portions of the loader that are rough and jagged. In addition to providing a highly desirable appearance for the loader, the smooth features of the cover system help to prevent the loader from snagging on and damaging objects that the loader passes in close proximity. For example, a pine tree may be rendered unfit for use as a Christmas tree if some of the branches are damaged by getting caught at snag points on the loader arm. The smooth loader cover arm may reduce the number of snag points and reduce the risk to trees that the loader passes.

Figure 49:
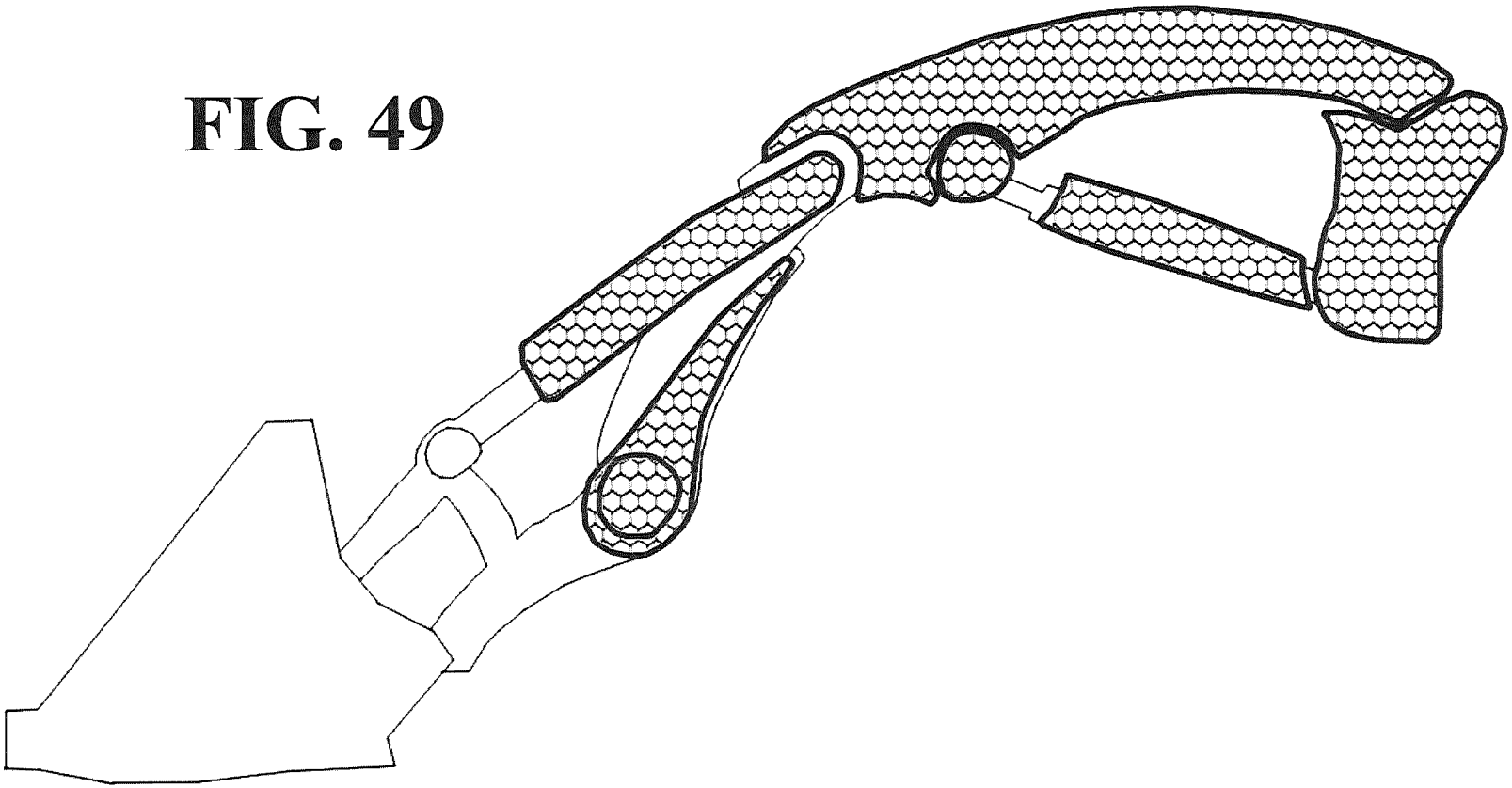
FIG. 49 shows a side view of a substantially modular loader arm and cylinder cover system with sections that are distinguishable from the loader arm by a color or texture.
Figure 50:
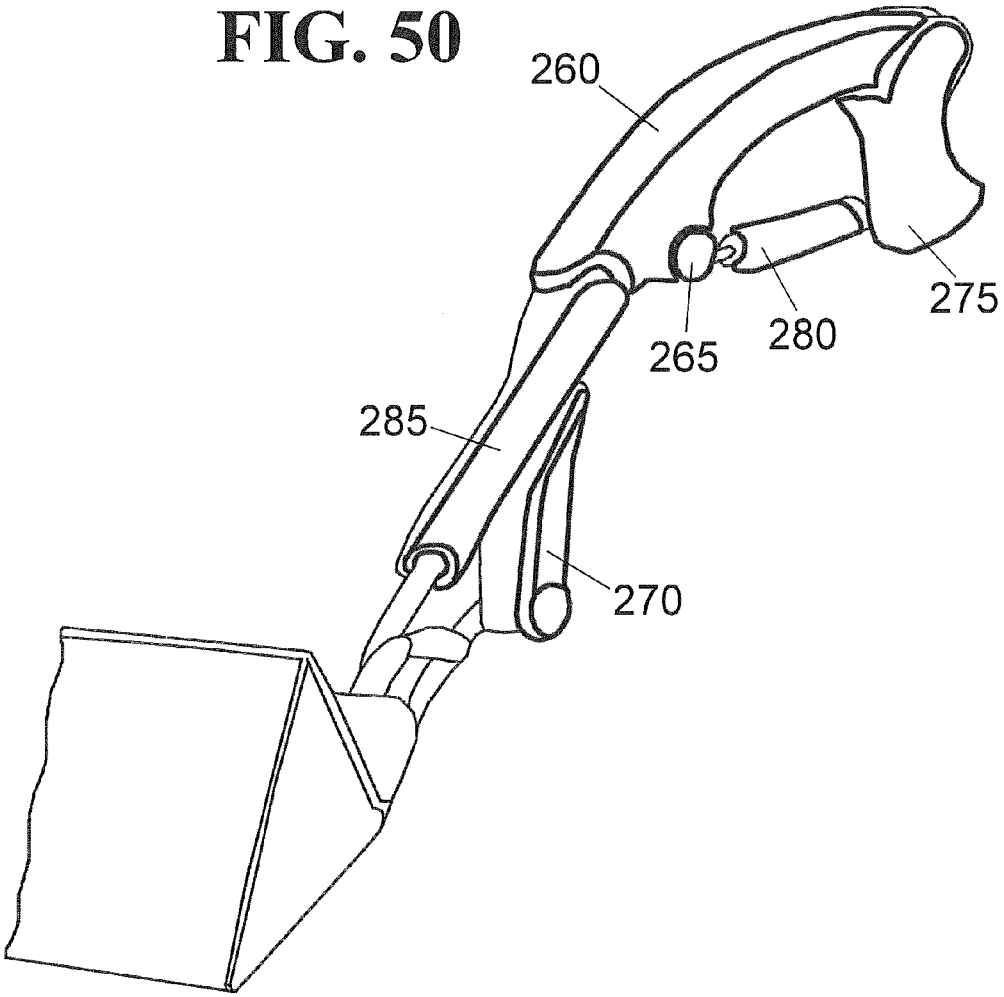
FIG. 50 shows a perspective view of a substantially modular loader arm and cylinder cover system.
Figure 51:
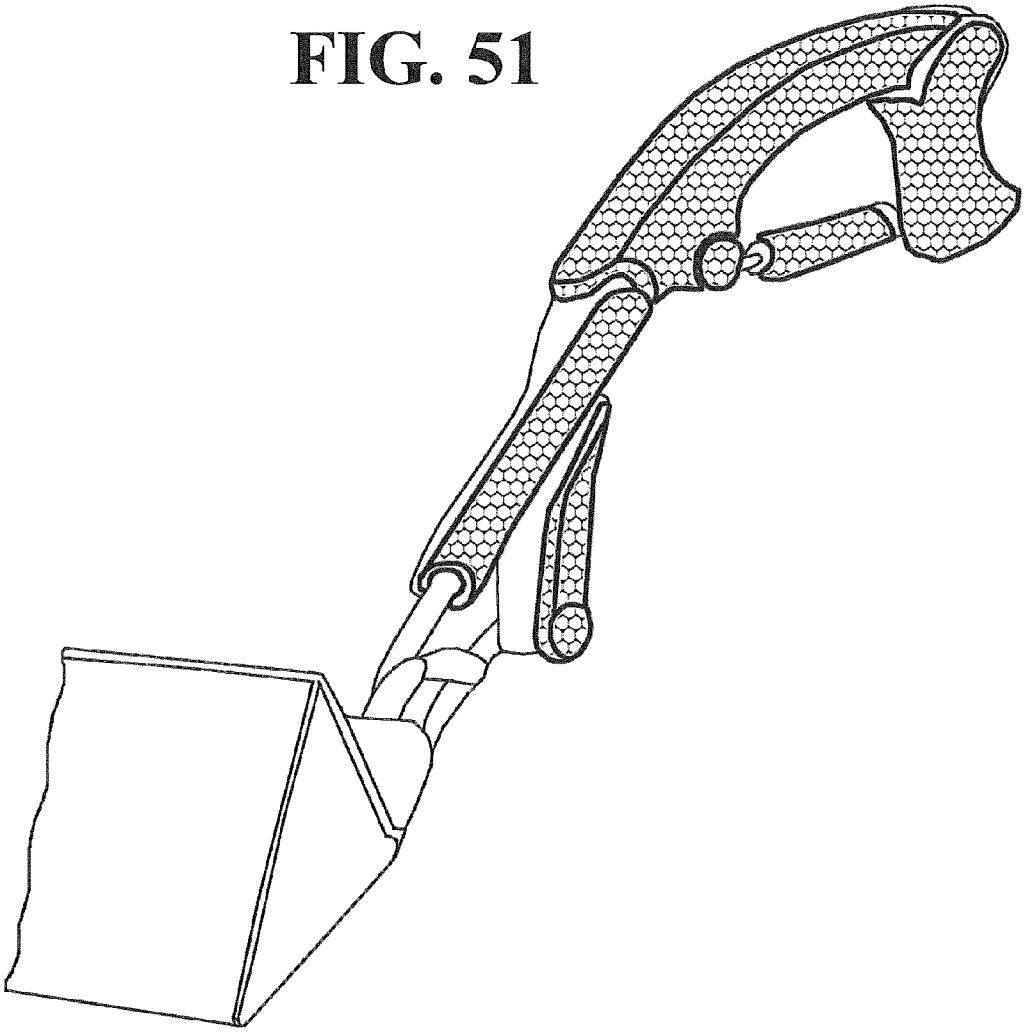
FIG. 51 shows a perspective view of a substantially modular loader arm and cylinder cover system with sections that are distinguishable from the loader arm and cylinders by colors or textures.

FIGS. 49 and 51 illustrate segmented cover systems where portions are colored or textured to distinguish the cover from the rest of the loader. Coloring/texturing of the cover portions aides in identifying (and replacing) worn sections of the cover before the integrity of the cover is significantly compromised. The segmentation of the loader cover system allows loader operators to further customize the look of their loaders by utilizing multiple textures or colors. For example, near the Fourth of July, a loader owner may choose to put red, white, and blue covers on their loader. In addition to allowing individual expression, the unique appearance of loader may assist in identifying the loader or the location associated with the loader. For example, a loader with a unique appearance may serve to identify one specific crop field to an aerial crop duster.

Figure 52A:
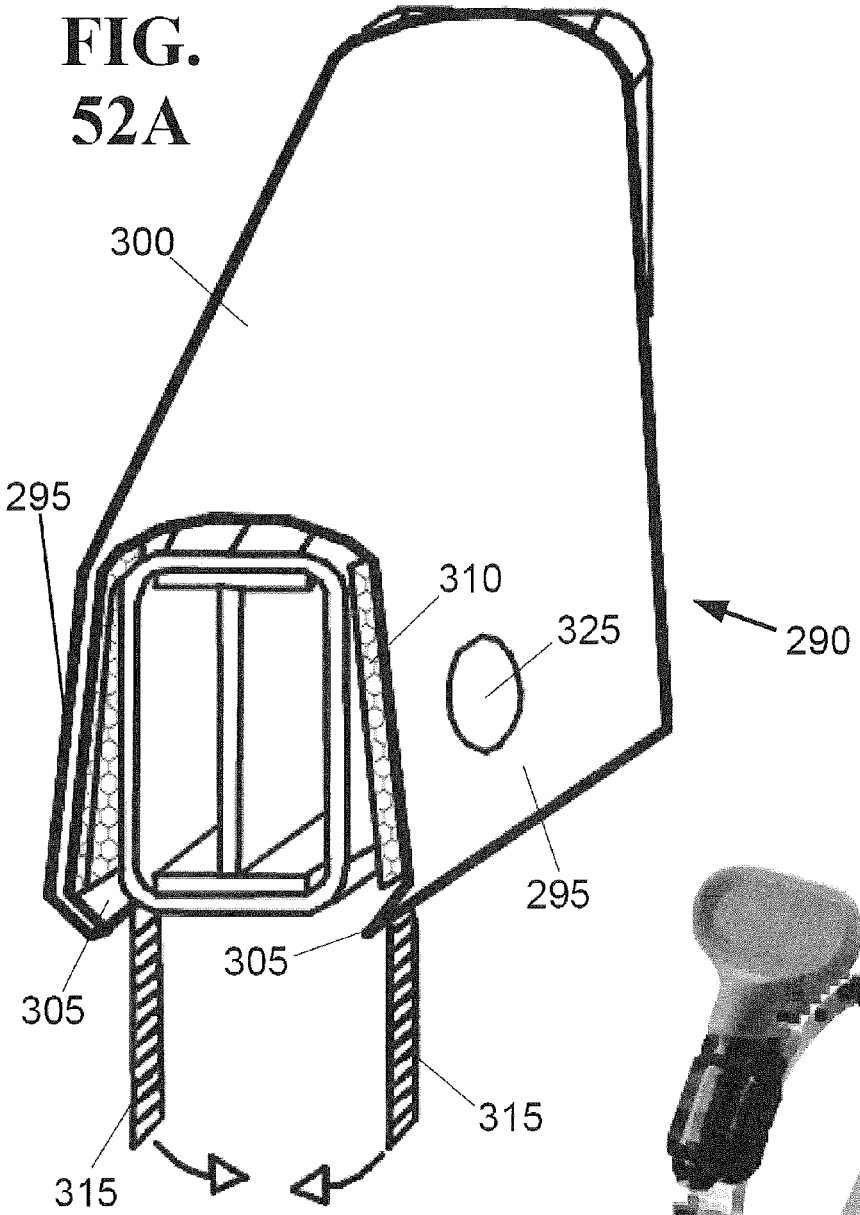
FIG. 52A shows a perspective view of a flexible opaque loader arm cover having two flexible sides connected to a rounded top cover portion.
Figure 53:
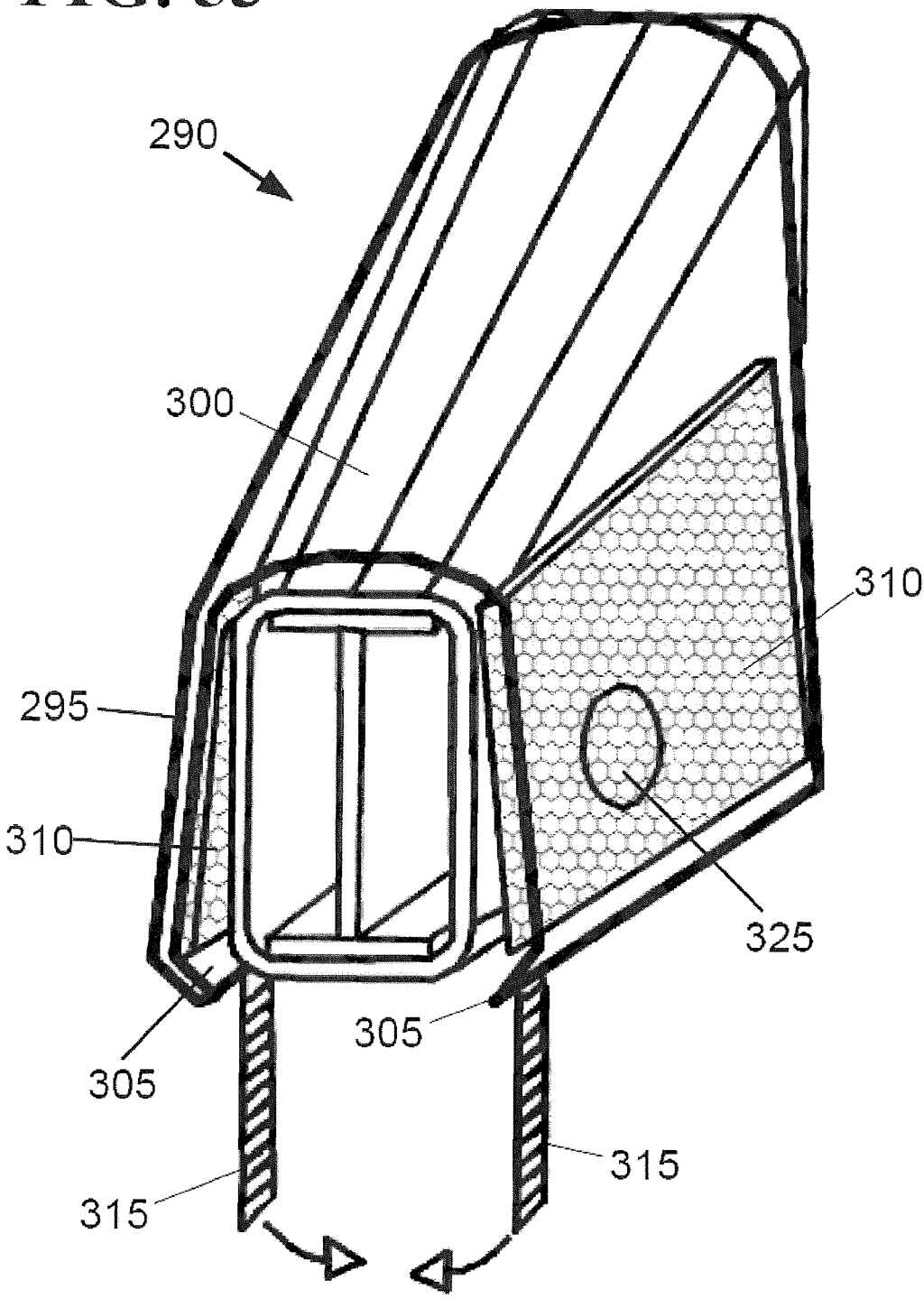
FIG. 53 shows a perspective view of a flexible and translucent loader arm cover having a tie down strap capable of securing the cover to the arm by compacting two compressible portions against the loader arm.

FIGS. 52A and 53 each show a flexible loader cover 290 with two side portions 295 connected together by a rounded top portion 300. Connected below each of the side portions are under tabs 305 adapted to wrap around and assist in securing the cover to the loader arm. Located between each of the side portions is a compressible pad 310 adapted for assisting in securing the flexible loader cover to the loader arm. In an exemplary embodiment of the invention, the compressible pad 310 is made primarily from an expanded polymer such as polyvinyl chloride (PVC), however the compressible pad may also be made from an assortment of other materials including minerals, petroleum based products, plant derived products (natural rubber, etc), and animal based products.

In one embodiment of the invention, the shape of the compressible pad is substantially defined by either the loader arm or the side portions of the flexible cover. Alternatively, the flexible pads may have a different shape designed to better secure the cover to the loader arm. In yet another embodiment of the invention, the compressible pad is shaped so that when secured to the loader arm an array of specifically oriented protrusions are created in side portions. For example, the word "Westendorf" may be ink printed on the exterior of the side portion and when the loader cover is secured to the loader protrusions form the words "loader cover" below the printed text. In yet another embodiment of the invention, an inner sheet cooperates with the side portion to enclose the compressible pad.

Figure 52B:
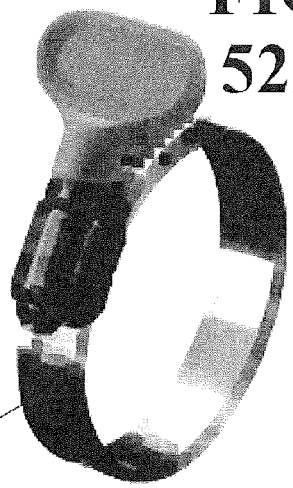
FIG. 52B shows an example of a fastener for securing the flexible opaque loader arm cover.

The covers shown in FIGS. 52A and 53 include fasteners 315 adapted for securing the flexible loader arm covers to the loader. The fasteners may be adapted to secure the loader cover to one specific make or model of loader arm, or the fasteners may be capable of securing the cover to a myriad of different loaders. For example, the fasteners may be designed to easily connect to specific portions of a loader arm, or the fasteners may magnetically connect to one of many metallic loader arm portions. FIG. 52B illustrates an example of a metal fastener 320 capable of securing the flexible cover to the loader arm.

The side portions of the flexible covers may include holes adapted for receiving the cylinder pins 325 of the loader arm. The connection of the holes with the cylinder pins assist in preventing movement of the cover about the length of the loader arm.

The inventor contemplates several alterations and improvements to the disclosed invention. Other materials and methods of manufacture will be obvious to those of reasonable skill in the art and are within the scope of the invention. Other alterations, variations, and combinations are possible that fall within the scope of the present invention. Although various embodiments of the present invention have been described, those skilled in the art will recognize more modifications that may be made that would nonetheless fall within the scope of the present invention. Therefore, the present invention should not be limited to the apparatus described. Instead, the scope of the present invention should be consistent with the invention claimed below.

I claim:

1. A mechanical system comprising:

a loader arm with a vertically curved region, the loader arm rotatably secured between a vehicle and an implement for raising and lowering the implement relative to the vehicle;

a first hydraulic fluid line extending from the vehicle to a first hydraulic cylinder secured between the loader arm and the implement and adapted to move the implement relative to the loader arm;

a second hydraulic fluid line extending from the vehicle to a second hydraulic cylinder secured to the loader arm and adapted to raise and lower the loader arm relative to the vehicle; and a transmission line guard holds the first hydraulic fluid line adjacent to the loader arm, the transmission line guard secured both around the loader arm between the vertically curved region and the vehicle, and around the loader arm between the vertically curved region and the implement.

2. The mechanical system of claim 1 wherein the transmission line guard has a rounded section that accepts the first hydraulic line from the vehicle.

3. The mechanical system of claim 2 further comprising the first hydraulic cylinder secured to the loader arm at a hinge; and the transmission line guard having a first curved joint section adjacent to the hinge.

4. The mechanical system of claim 3 further comprising the second hydraulic cylinder secured to the loader arm at a joint; and the transmission line guard having a second curved joint section adjacent to the joint.

5. The mechanical system of claim 1 wherein the transmission line guard includes a plurality of access vents passing through the transmission line guard perpendicular to the loader arm.

6. The mechanical system of claim 1 wherein the transmission line guard includes a translucent portion for facilitating inspection of the first hydraulic line.

7. The mechanical system of claim 1 wherein the transmission line guard having a wear surface laterally extending away from the loader arm, the wear surface including a plurality of grooves.

8. The mechanical system of claim 1 further comprising a detachable wear surface secured to the transmission line guard, the detachable wear surface having a wear surface laterally extending away from the loader arm.

9. The mechanical system of claim 1 wherein the transmission line guard surrounds substantially all of the loader arm between the vertically curved region and the vehicle.

10. The mechanical system of claim 1 further comprising a second arm guard secured to the loader arm between the transmission line guard and the implement.

11. The mechanical system of claim 1 wherein the transmission line guard includes a metal fastener below the loader arm secured to a first vertical side portion and a second vertical side portion of the transmission line guard, the first and second vertical side portions flanking the loader arm.

12. The mechanical system of claim 1 further comprising a compression pad located between the loader arm and the transmission line guard.

13. The mechanical system of claim 1 wherein the transmission line guard includes a plurality of access vents passing through the transmission line guard perpendicular to the loader arm;

the transmission line guard includes a cylinder pin hole passing through the transmission line guard perpendicular to the loader arm; and the cylinder pin hole is larger than one of the access vents.

14. The mechanical system of claim 1 further comprising the transmission line guard including a raised wear surface, and an implement guard secured to the implement.

15. The mechanical system of claim 1 wherein the transmission line guard is constructed form a flexible material and a plurality of fasteners secure the transmission line guard to the loader arm cover.

16. A mechanical system comprising:

a loader arm rotatably secured between a vehicle and an implement for raising and lowering the implement relative to the vehicle;

a first hydraulic fluid line extending from the vehicle to a first hydraulic cylinder secured between the loader arm and the implement and adapted to move the implement relative to the loader arm, the first hydraulic cylinder secured to the loader arm at a hinge;

a second hydraulic fluid line extending from the vehicle to a second hydraulic cylinder secured to the loader arm and adapted to raise and lower the loader arm relative to the vehicle; and a transmission line guard holds the first hydraulic fluid line adjacent to the loader arm, the transmission line guard has a first rounded section that accepts the first hydraulic line from vehicle, and the transmission line guard has a second rounded section that accepts the first hydraulic line from vehicle.

17. The mechanical system of claim 16 wherein the transmission line guard includes a plurality of access vents passing through the transmission line guard perpendicular to the loader arm.

18. The mechanical system of claim 16 further comprising a detachable wear surface secured to the transmission line guard, the detachable wear surface having a wear surface laterally extending away from the loader arm.

* * * * *